US009017153B2

(12) United States Patent
Yamamoto et al.

(10) Patent No.: US 9,017,153 B2
(45) Date of Patent: Apr. 28, 2015

(54) ELEVATOR AIR PRESSURE CONTROL DEVICE

(75) Inventors: Keigo Yamamoto, Tokyo (JP); Masaji Iida, Tokyo (JP); Toshiya Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1130 days.

(21) Appl. No.: 12/741,451

(22) PCT Filed: Nov. 9, 2007

(86) PCT No.: PCT/JP2007/071829
§ 371 (c)(1),
(2), (4) Date: May 5, 2010

(87) PCT Pub. No.: WO2009/060545
PCT Pub. Date: May 14, 2009

(65) Prior Publication Data
US 2010/0267322 A1 Oct. 21, 2010

(51) Int. Cl.
*B66B 7/00* (2006.01)
*B66B 11/02* (2006.01)

(52) U.S. Cl.
CPC ..... *B66B 11/0226* (2013.01)

(58) Field of Classification Search
USPC ..... 454/68; 187/288, 314; 73/1.57
See application file for complete search history.

(56) References Cited

U.S. PATENT DOCUMENTS 4,592,270 A * 6/1986 Vener ..... 454/68
5,080,003 A * 1/1992 Kappeler ..... 454/68

(Continued)

FOREIGN PATENT DOCUMENTS

JP 7 112879 5/1995
JP 08 081162 3/1996

(Continued)

OTHER PUBLICATIONS

Funai, Kiyoshi et al., "Analysis of Tympanic Membrane Behavior and Ear Block Discomfort for Super High Speed Elevators", The Japan Society of Mechanical Engineers, Elevator, Escalator and Amusement Rides Conference, 4 Pages, Jan. 21, 2004, (with English abstract).

(Continued)

*Primary Examiner* — Steven B McAllister
*Assistant Examiner* — Samantha Miller
(74) *Attorney, Agent, or Firm* — Oblon, McClelland, Maier & Neustadt, L.L.P.

(57) ABSTRACT

It is an object to ease discomfort feeling caused by ear fullness for passengers of an elevator. An air pressure control device 104 controls an air pressure in an elevator car 102 using an air pressure adjusting device 105 such as a blower, an air compressor, etc. In the air pressure control device 104, a departure/arrival control unit 121 largely changes the air pressure in the elevator car 102 in the first period which is a time zone at the time of departing from a departure floor (or at the time of arriving at an arrival floor), and an except departure/arrival control unit 122 slightly changes the air pressure in the elevator car 102 in the subsequent second period (or in a time period until arrival). By this 2-step air pressure control, the passenger is prompted to clear the ear in a short time $T_1$, the ear fullness is resolved by the ear clearing, and thereafter, the passenger can ascend/descend with the elevator car 102 comfortably until arriving at the arrival floor.

23 Claims, 24 Drawing Sheets

(56) References Cited

U.S. PATENT DOCUMENTS

| | | | | |
|---|---|---|---|---|
| 5,306,208 | A * | 4/1994 | Sommerrock et al. | 454/68 |
| 5,354,233 | A * | 10/1994 | Mandy et al. | 454/68 |
| 5,460,570 | A * | 10/1995 | Okamura et al. | 454/68 |
| 5,593,347 | A * | 1/1997 | Mandy et al. | 454/68 |
| 5,718,627 | A * | 2/1998 | Wicks | 454/68 |
| 5,834,713 | A * | 11/1998 | Huang | 187/391 |
| 6,616,720 | B1 * | 9/2003 | Smith | 55/385.2 |
| 7,059,958 | B2 * | 6/2006 | Santos | 454/68 |
| 7,267,203 | B2 * | 9/2007 | Sekimoto | 187/393 |
| 7,284,640 | B2 * | 10/2007 | Lee | 187/413 |
| 7,762,875 | B2 * | 7/2010 | Sekimoto | 454/68 |
| 8,365,804 | B1 * | 2/2013 | Genovese et al. | 160/351 |
| 2005/0124282 | A1 * | 6/2005 | Santos | 454/68 |
| 2007/0010190 | A1 * | 1/2007 | Butler | 454/171 |
| 2007/0218823 | A1 * | 9/2007 | Wolf | 454/72 |
| 2008/0108295 | A1 * | 5/2008 | Fischer et al. | 454/239 |
| 2008/0207106 | A1 * | 8/2008 | Sekimoto | 454/68 |
| 2008/0274684 | A1 * | 11/2008 | Peng et al. | 454/68 |
| 2010/0015909 | A1 * | 1/2010 | Bacharach | 454/365 |
| 2011/0097986 | A1 * | 4/2011 | Cursetjee et al. | 454/187 |
| 2012/0096802 | A1 * | 4/2012 | Davenport | 52/741.4 |

FOREIGN PATENT DOCUMENTS

| | | |
|---|---|---|
| JP | 10 226477 | 8/1998 |
| JP | 2002 96983 | 4/2002 |
| JP | 2005 119882 | 5/2005 |

OTHER PUBLICATIONS

Office Action issued Jun. 19, 2012 in Japanese Application No. 2009-539929 (With English Translation).

Office Action issued Oct. 26, 2011 in Korean Patent Application No. 10-2010-7008741 (with partial English translation).

Chinese Office Action issued Jul. 4, 2012, in China Patent Application No. 200780101417.5 (with English Translation).

The Extended European Search Report issued Jan. 3, 2014, in Application No. / Patent No. 07831560.3-1705 / 2206671 PCT/JP2007071829.

* cited by examiner

ELEVATOR AIR PRESSURE CONTROL DEVICE

TECHNICAL FIELD

The present invention relates to an elevator air pressure control device controlling air pressure in an elevator car.

BACKGROUND ART

FIG. 24 is a diagram showing air pressure control pattern when a conventional elevator car descends.

In FIG. 24, in a conventional elevator apparatus (Patent Document 1 and Patent Document 2), air pressure in the elevator car while ascending/descending, which changes like an uncontrolled pattern 201 when it is uncontrolled, is changed with a certain changing rate as shown by a straight line control pattern 202. By this operation, even if the ascending/descending speed of the elevator becomes high, the air pressure changing rate (a ratio of changing of the air pressure with respect to time) is milder than the case of uncontrolled.

Further, Non-patent Document 1 shows that there is little relationship between ear fullness and the air pressure changing rate.

Patent Document 1: JP2005-119882A

Patent Document 2: JP08-81162A

Non-patent Document 1: Kiyoshi Funai, Yoshikatsu Hayashi, Takayuki Koizumi, Nobutaka Tsujiuchi, and Mitsuharu Okamoto, "Analysis of Tympanic Membrane Behavior and Ear Block Discomfort for Super High Speed Elevators." The Japan Society of Mechanical Engineers. Elevator, Escalator and Amusement Rides Conference, Jan. 21, 2004, pp. 27-30.

DISCLOSURE OF THE INVENTION

Problems to be Solved by the Invention

Because of this, it is considered that it is impossible to largely ease discomfort feeling of ear fullness of passengers which occurs at ascending/descending time of the elevator by the conventional air pressure controlling method.

Further, even if the ear fullness is temporarily eased by ear clearing such as swallowing, etc. while the elevator is ascending/descending, it is anticipated that the passengers may feel ear fullness again after a certain time passes.

The present invention aims to, for example, ease discomfort feeling caused by ear fullness for passengers of the elevator.

Means to Solve the Problems

According to the present invention, an elevator air pressure control device in an elevator car has an air pressure adjusting device, and is provided for carrying out at least one of air pressure control of controlling the air pressure adjusting device for decreasing air pressure when the elevator car ascends and controlling the air pressure adjusting device for increasing the air pressure when the elevator car descends. It comprises a first air pressure changing unit configured to control the air pressure adjusting device to change the air pressure in the elevator car by a predetermined first air pressure changing amount during a predetermined first portion of a time period during which the elevator car is moving between two floors; and a second air pressure changing unit configured to control the air pressure adjusting device to change the air pressure in the elevator car by a predetermined second air pressure changing amount during a predetermined second portion of the time period during which the elevator car is moving between the two floors.

The first portion of the time period is at least one of a departure time having a predetermined time length starting when the elevator car departs from a departure floor and an arrival time having a predetermined time length terminating when the elevator car arrives at an arrival floor, and the second portion of the time period is a time while the elevator car is moving between the two floors, excluding the first portion of the time period.

The time length of the first portion of the time period is shorter than a time length of the second portion of the time period.

The first portion of the time period is a departure time starting when the elevator car departs from the departure floor, and a time length of the first portion of the time period is no more than a time length required by the elevator car to reach a maximum speed after the elevator car starts moving. The second portion of the time period is an arrival time terminating when the elevator car arrives at the arrival floor, and a time length of the second portion of the time period is no more than a time length required by the elevator car for stopping after the elevator car starts decelerating from the maximum speed.

The first air pressure changing amount is larger than the second air pressure changing amount.

The first air pressure changing amount is larger than an air pressure changing amount corresponding to a height difference caused by movement of the elevator car in the first portion of the time period.

The first air pressure changing amount is larger than an air pressure changing amount corresponding to a height difference caused by movement of the elevator car in a time length of the first portion of the time period at an average speed of movement from the departure floor to the arrival floor.

The first air pressure changing amount is at least 2400 Pa during descent of the elevator car and at least 2000 Pa during ascent of the elevator car.

The first air pressure changing amount when the elevator car descends is larger than the first air pressure changing amount when the elevator car ascends.

A first air pressure changing rate which is an average changing rate of the air pressure in the elevator car in the first portion of the time period is larger than a second air pressure changing rate which is an average changing rate of the air pressure in the elevator car in the second portion of the time period.

The elevator air pressure control device controls the air pressure in the elevator car by controlling an elevator air pressure adjusting device which adjusts the air pressure in the elevator car, and the first air pressure changing rate which is an average changing rate of the air pressure in the elevator car in the first time zone is a maximum value of an air pressure changing rate specified based on at least one of adjusting performance of the elevator air pressure adjusting device and pressure resistant performance of the elevator car.

The first air pressure changing unit specifies the first air pressure changing amount based on the departure floor and the arrival floor.

The elevator air pressure control device further includes: a third air pressure changing unit for changing the air pressure in the elevator car with a predetermined third air pressure changing amount in a predetermined third portion of the time period while the elevator car is moving.

The first portion of the time period is a departure time having a predetermined time length starting when the elevator car departs from the departure floor. The third portion of the time period is an arrival time having a predetermined time length terminating when the elevator car arrives at the arrival floor. The second portion of the time period is an intermediate time after the departure time and before the arrival time the elevator car is moving.

The first air pressure changing amount is a value which is previously decided as an air pressure changing amount by which a passenger in the elevator car opens a Eustachian tube, the second air pressure changing amount is a value which is previously decided as an air pressure changing amount after the passenger opens the Eustachian tube until starts feeling ear-closed feeling, and the third air pressure changing amount is a value which is obtained by subtracting the first air pressure changing amount and the second air pressure changing amount from a total air pressure changing amount which is an air pressure changing amount corresponding to a height difference between the departure floor and the arrival floor.

According to the present invention, an elevator air pressure control device in an elevator car has an air pressure adjusting device, and is provided for carrying out at least one of air pressure control of controlling the air pressure adjusting device for decreasing air pressure when the elevator car ascends and controlling the air pressure adjusting device for increasing the air pressure when the elevator car descends. It comprises a 2-step air pressure changing unit configured to control the air pressure adjusting device to change the air pressure in the elevator car by a redetermined departure/arrival air pressure changing amount during a predetermined departure/arrival portion of a time period during which the elevator car is moving between two floors, wherein the predetermined departure/arrival portion of a time period during which the elevator car is moving between two floors is one of a predetermined departure time period starting when the elevator car departs from a departure floor and a predetermined arrival time period terminating when the elevator car arrives at an arrival floor, and to change the air pressure in the elevator car by a predetermined except departure/arrival air pressure changing amount during the time period during which the elevator car is moving between two floors other than the predetermined departure/arrival portion. A 3-step air pressure changing unit is configured to control the air pressure adjusting device to change the air pressure in the elevator car by a predetermined departure air pressure changing amount during the predetermined departure time period, to change the air pressure in the elevator car by a predetermined arrival air pressure changing amount during the predetermined arrival time period, and to change the air pressure in the elevator car by a predetermined air pressure changing amount that is different from either of the predetermined departure air pressure changing amount and the predetermined arrival air pressure changing amount, during the time period during which the elevator car is moving between two floors other than the predetermined departure time period and the predetermined arrival time period. The elevator air pressure control device is configured to select one of the 2-step air pressure changing unit and the 3-step air pressure changing unit to control the air pressure adjusting device to change the air pressure in the elevator car, based on a determination of a departure floor and arrival floor of the elevator car.

Effect of the Invention

According to the present invention, it is possible to, for example, ease discomfort feeling caused by ear fullness for the passengers of the elevator by increasing/decreasing the air pressure in the ascending/descending elevator car with two steps of the first air pressure changing amount and the second air pressure changing amount.

PREFERRED EMBODIMENTS FOR CARRYING OUT THE INVENTION

Embodiment 1

FIG. 1 is a configuration diagram of an elevator 100 according to the first embodiment.

In FIG. 1, an elevator car 102 of the elevator 100 is hanged by a suspension rope 108 together with a counterweight 106, and the elevator car 102 ascends/descends in a hoistway 101 by winding up the suspension rope 108 with a hoisting machine 107. Further, an elevator control device 109 (illustration omitted) makes the elevator car 102 ascend/descend or stop by controlling the hoisting machine 107, and the elevator control device 109 further controls opening/closing of a door of the elevator car 102.

The air pressure in the ascending/descending elevator car 102 is controlled by an air pressure adjusting device 105 such as a blower or an air compressor attached to the elevator car 102 with increasing/decreasing the air pressure.

The elevator 100 in the first embodiment is characterized to have an air pressure control device 104 which controls the air pressure in the elevator car 102 by controlling the air pressure adjusting device 105.

As for a high-rise elevator 100 provided in a high-rise building, since there is a large difference in height between a low-level floor (the first floor, for example) and a high-level floor (the top floor, for example), the air pressure changing amount in the ascending/descending elevator car 102 is large. Then, the passengers feel ear fullness due to the large air pressure change in the elevator car 102 while the elevator car 102 is ascending/descending. For example, in the elevator 100 which directly goes up and down between the first floor and the top floor without stopping at any other floor, the passengers feel ear fullness due to the air pressure difference between the air pressure $P_d$ of the first floor and the air pressure $P_t$ of the top floor while descending after the passengers get on the elevator car 102 at the elevator boarding place 103*a* of the top floor until the elevator car 102 arrives at the first floor and while ascending after the passengers get on the elevator car 102 at the elevator boarding place 103*b* of the first floor until the elevator car 102 arrives at the top floor.

The discomfort feeling caused by the ear fullness is called as "ear block" or "ear-closed feeling", which is felt by expansion of the tympanic membrane towards the external ear (outer side of the tympanic membrane) side or the middle ear (inner side of the tympanic membrane) side because of the air pressure difference between the air pressure at the external ear and the air pressure at the middle ear. A human (or an animal) feels discomfort feeling caused by this ear fullness when changing amount of ambient air pressure is large such as at the time of departure/arrival of an airplane or the time of entering to a tunnel of a train as well as the time of ascending/descending of the elevator.

Hereinafter, "the discomfort feeling caused by the ear fullness" is called as "the ear-closed feeling".

The ear-closed feeling can be resolved by opening the Eustachian tube which connects the middle ear and the nasal cavity to intake external air from the nasal cavity to the middle ear and making a balance between the air pressure at the middle ear side and the air pressure at the external ear side.

The resolution of the ear-closed feeling includes "positive opening of Eustachian tube", by which the human intentionally opens the Eustachian tube and "passive opening of Eustachian tube" by which the Eustachian tube automatically opens.

"Positive opening of Eustachian tube" is carried out by swallowing (swallowing saliva), yawning, etc., and is generally called as "ear clearing".

"Passive opening of Eustachian tube" occurs automatically when the air pressure at the middle ear side is larger than the air pressure at the external ear side; namely, it is caused by the air pressure difference between the middle ear side and the external ear side when the ambient air pressure is decreased.

Although it varies individually, when the ambient air pressure changes from "low" to "high" (at descending time of the elevator, for example), if the changing amount of the air pressure reaches around 2400 Pa (pascal) to 4800 Pa, the ear-closed feeling increases, and thus a human positively carries out opening of the Eustachian tube by the ear clearing to resolve the ear-closed feeling. Further, when the ambient air pressure changes from "high" to "low" (at ascending time of the elevator, for example), if the changing amount of the air pressure reaches around 2000 Pa, the passive opening of the Eustachian tube occurs to resolve the ear-closed feeling.

Here, since the air pressure changes around 1200 Pa per a height difference of 100 m (meter), the changing amount 2400 Pa of the air pressure which causes the positive opening of the Eustachian tube corresponds to the changing amount of the air pressure when the elevator moves downward with around 200 m; the changing amount 2000 Pa of the air pressure which causes the passive opening of the Eustachian tube corresponds to the changing amount of the air pressure when the elevator moves upward with around 167 m.

FIG. 2 is a functional configuration diagram of the air pressure control device 104 according to the first embodiment.

The functional configuration of the air pressure control device 104 according to the first embodiment will be explained in the following with reference to FIG. 2.

The air pressure control device 104 includes a 2-step control unit 120, and thereby the air pressure within the elevator car 102 is controlled during moving (while ascending, descending) and the ear-closed feeling of the passengers in the elevator car 102 is eased.

The 2-step control unit 120 (2-step air pressure changing unit) controls the air pressure adjusting device 105 according to a predetermined 2-step control pattern 210, and thereby the air pressure in the ascending elevator car 102 is decreased with two steps, and as well the air pressure in the descending elevator car 102 is increased with two steps. For example, the air pressure adjusting device 105 is an air blower or an air compressor attached to the elevator car 102, which increases/decreases air pressure in the elevator car 102 with the predetermined 2-step control pattern 210 according to the control of the 2-step control unit 120.

Further, the air pressure control device 104 includes a CPU (Central Processing Unit) (illustration omitted) or a memory (memory equipment) (illustration omitted). The memory of the air pressure control device 104 previously stores a predetermined 2-step control pattern 210. Further, the 2-step control unit 120 adjusts the supply amount and the supply time of electric power to the air pressure adjusting device 105 and outputs a command signal showing the 2-step control pattern 210 using the CPU, thereby controlling the air pressure adjusting device 105.

The 2-step control unit 120 includes a departure/arrival control unit 121 (an example of the first air pressure changing unit) which makes the air pressure adjusting device 105 increase/decrease the air pressure in the elevator car 102 with a predetermined departure changing amount during a portion of the time period during which the elevator car is moving between two floors having a predetermined time length which starts when the elevator car 102 departs from the departure floor (a departure time zone, hereinafter).

Further, the 2-step control unit 120 includes an except departure/arrival control unit 122 (an example of the second air pressure changing unit) which makes the air pressure adjusting device 105 increase/decrease the air pressure in the elevator car 102 with a predetermined except departure changing amount during a portion of the time period during which the elevator car is moving between two floors after the departure time zone and until the elevator car 102 arrives at the arrival floor, namely, a time during the ascending/descending of the elevator car 102 except the departure time zone (an except departure time zone, hereinafter).

The departure time zone (an example of the first time zone), the departure air pressure changing amount (an example of the first air pressure changing amount), and a departure air pressure changing rate (an example of the first air pressure changing rate) are shown by the 2-step control pattern 210. The departure air pressure changing rate means an average changing rate of air pressure within the elevator car 102 during the departure time zone.

Further, the except departure time zone (an example of the second time zone), the except departure air pressure changing amount (an example of the second air pressure changing amount), and an except departure air pressure changing rate (an example of the second air pressure changing rate) are shown by the 2-step control pattern 210. The except departure air pressure changing rate means an average changing rate of air pressure within the elevator car 102 during the except departure time zone.

The departure time zone, the departure air pressure changing amount, the departure air pressure changing rate, the except departure time zone, the except departure air pressure changing amount, and the except departure air pressure changing rate can be defined with certain values or defined according to a vertical travel distance (a difference in height of ascending/descending) of the elevator car 102. For example, in the elevator 100 which connects the low-level floor (the first floor, for example) and the high-level floor (an observation floor, for example) directly, these values are defined as certain values. An embodiment to define these values according to the vertical travel distance of the elevator car 102 will be explained in the fourth embodiment.

The 2-step control pattern 210 includes the 2-step control pattern 210 used for the descending elevator car 102 and the 2-step control pattern 210 used for the ascending elevator car 102; both 2-step control patterns are defined previously and stored in a memory of the air pressure control device 104.

The 2-step control unit 120 inputs information showing a moving direction (ascending or descending) of the elevator car 102 from the elevator control device 109, selects the 2-step control pattern 210 according to the moving direction shown by the inputted information, and obtains the 2-step control pattern 210 from the memory.

Then, the departure/arrival control unit 121 and the except departure/arrival control unit 122 control the air pressure adjusting device 105 according to the 2-step control pattern 210 selected by the 2-step control unit 120, thereby increasing/decreasing the air pressure in the elevator car 102.

Here, the departure floor and the arrival floor are called for one-way trip. For example, in case of ascending to the top floor from the first floor, the first floor is the departure floor, and the top floor is the arrival floor. Further, in case of descending to the first floor from the top floor, the top floor is the departure floor and the first floor is the arrival floor.

FIG. 3 is a graph showing the 2-step control pattern 210 when the elevator car 102 is descending according to the first embodiment.

FIG. 4 is a graph showing the 2-step control pattern 210 when the elevator car 102 is ascending according to the first embodiment.

A detail of the 2-step control pattern 210 for easing the ear-closed feeling of the passengers in the elevator car 102 will be explained in the following based on FIGS. 3 and 4.

In FIGS. 3 and 4, the horizontal axis shows a time (unit: second); the time passes from the left to the right of the graph. Further, the vertical axis shows the air pressure in the elevator car 102 (unit: pascal); the air pressure increases from the bottom to the top.

A point X is the air pressure in the elevator car 102 when the elevator car 102 starts ascending, which shows the air pressure at the height of the departure floor. A point Y is the air pressure in the elevator car 102 when the elevator car 102 finishes ascending, which shows the air pressure at the height of the arrival floor.

A line L shows a time to switch from "the first period" to "the second period"; a point Z, a point W, and a point V show intersecting points with the 2-step control pattern 210, the uncontrolled pattern 201, and the constant changing pattern 203, respectively. Namely, the point Z, the point W, and the point V show the air pressure in the elevator car 102 at the ending time of "the first period" of the 2-step control pattern 210, the uncontrolled pattern 201, and the constant changing pattern 203, respectively.

Here, the uncontrolled pattern 201 and the constant changing pattern 203 will be explained first.

The uncontrolled pattern 201 shows the change of the air pressure in the elevator car 102 when no control is conducted. The uncontrolled air pressure in the elevator car 102 is almost the same as the air pressure at the height where the elevator car 102 is located, so that the air pressure increases according to the passage of time in FIG. 3 in which the elevator car 102 is descending; and the air pressure decreases according to the passage of time in FIG. 4 in which the elevator car 102 is ascending. Further, in the uncontrolled pattern 201, since the ascending/descending speed of the elevator car 102 is decreased at the time of starting ascending/descending when the elevator car 102 accelerates from the halting status (the left end side of the time axis) and at the time of finishing ascending/descending when the elevator car 102 decelerates (the right end side of the time axis), the changing amount of the air pressure in the elevator car 102 is small.

The constant changing pattern 203 shows a change of the air pressure in the elevator car 102 when the elevator car 102 moves up/down with a constant speed which is the average speed from the departure floor to the arrival floor. Therefore, the constant changing pattern 203 shows the air pressure in the elevator car 102 which is changed with a constant changing rate.

Next, the 2-step control pattern 210 will be explained.

The starting point of the 2-step control pattern 210 is the point X and the ending point is the point Y. Namely, the 2-step control pattern 210 shows that the air pressure in the elevator car 102 is made to be the air pressure of the departure floor at the departure floor and made to be the air pressure of the arrival floor at the arrival floor. By this operation, it is possible to prevent the passengers from feeling the ear-closed feeling due to the air pressure difference between the air pressure of the elevator boarding place 103 and the air pressure in the elevator car 102 when the passengers get in the elevator car 102 or get off the elevator car 102.

The 2-step control pattern 210 shows changing the air pressure in the elevator car 102 with two steps of "the first period" and "the second period". The 2-step control pattern 210 increases the air pressure in the elevator car 102 at "the first period" and "the second period" in FIG. 3 where the elevator car 102 is descending, and decreases the air pressure in the elevator car 102 at "the first period" and "the second period" in FIG. 4 where the elevator car 102 is ascending.

"The first period (an example of the first time zone)" shows the departure time zone having a predetermined length which starts when the elevator car 102 departs from the departure floor, and "the second period (an example of the second time zone)" shows the except departure time zone which starts after the departure time zone until the elevator car 102 arrives at the arrival floor.

In the 2-step control pattern 210, the changing amount of the air pressure (an example of the first air pressure changing amount; the departure air pressure changing amount) in the elevator car 102 in "the first period" is larger than the changing amount of the air pressure (an example of the second air pressure changing amount; the except departure air pressure changing amount) in the elevator car 102 in "the second period".

Hereinafter, the air pressure changing amount in the elevator car 102 is referred to simply as an air pressure changing amount.

Further, in "the first period", the air pressure changing amount of the 2-step control pattern 210 is larger than the air pressure changing amount of the uncontrolled pattern 201 (the changing amount of the air pressure corresponding to the height difference of moving up/down of the elevator car 102). In addition, in "the first period", the air pressure changing amount of the 2-step control pattern 210 is larger than the air pressure changing amount of the constant changing pattern 203 (the changing amount of the air pressure corresponding to the height difference of the elevator car 102 when the elevator car 102 moves up/down with the average speed from the departure floor to the arrival floor).

In "the first period", the air pressure changing amount of the 2-step control pattern 210 is represented by an absolute value of the air pressure difference between the air pressure in the elevator car 102 shown by the point X and the air pressure in the elevator car 102 shown by the point Z.

Similarly, in "the first period", the air pressure changing amount of the uncontrolled pattern 201 is represented by an absolute value of the air pressure difference between the point X and the point W; the air pressure changing amount of the constant changing pattern 203 is represented by an absolute value of the air pressure difference between the point X and the point V.

Further, the 2-step control pattern 210 shows an estimated value of the air pressure changing amount by which the passengers in the elevator car 102 open the Eustachian tube as the air pressure changing amount in "the first period".

For example, in FIG. 3 when the elevator car 102 is descending, the air pressure changing amount of the 2-step control pattern 210 in "the first period" is a predetermined value within a range of around 2400 Pa to 4800 Pa by which the positive opening of the Eustachian tube is carried out; in FIG. 4 when the elevator car 102 is ascending, the air pressure changing amount of the 2-step control pattern 210 in "the first period" is a value of around 2400 Pa by which the passive opening of the Eustachian tube is carried out.

When the elevator car 102 is descending, the ambient air pressure is increased, and the passive opening of the Eustachian tube does not occur, so that the air pressure changing amount of the 2-step control pattern 210 when the elevator car 102 is descending is set to be larger than the air pressure changing amount of the 2-step control pattern 210 when the elevator car 102 is ascending.

When the height difference of ascending/descending (the vertical travel distance) of the elevator car 102 is large, the passengers may open the Eustachian tubes multiple times while the elevator car 102 is ascending/descending. Here, when the height difference of ascending/descending of the elevator car 102 is large, the estimated value of the air pressure changing amount by which the passengers open the Eustachian tubes lastly is set to the air pressure changing amount of the 2-step control pattern 210 in "the first period".

For example, it is estimated that while the elevator car 102 is descending, if the passengers open the Eustachian tubes when the air pressure changing amount from the departure floor reaches "2400 Pa, 3600 Pa, 4400 Pa, 5000 Pa, . . . ", if the descending height difference of the elevator car 102 from the departure floor to the arrival floor is 400 m, since the air pressure increasing amount (an example of the total air pressure changing amount) corresponding to the height difference of the descending elevator car 102 is 4800 Pa (1200 Pa per 100 m), "4400 Pa" is set to the air pressure changing amount of the 2-step control pattern 210 in "the first period". 4400 Pa is the maximum air pressure changing amount estimated to be the air pressure changing amount no more than the air pressure increasing amount (4800 Pa) corresponding to the descending height difference of the elevator car 102 by which the passengers open the time.

However, it is not always necessary to set the estimated value of the air pressure changing amount by which the passengers open the Eustachian tubes to the air pressure changing amount of the 2-step control pattern 210 in "the first period". For example, a value being larger than the estimated value of the air pressure changing amount by which the passengers open the Eustachian tubes can be set to the air pressure changing amount of the 2-step control pattern 210 in "the first period".

Further, in the 2-step control pattern 210, the air pressure changing rate in the elevator car 102 in "the first period" (an example of the first air pressure changing rate; departure air pressure changing rate) is larger than the air pressure changing rate in the elevator car 102 in "the second period" (an example of the second air pressure changing rate; except departure air pressure changing rate).

Hereinafter, the changing rate of the air pressure in the elevator car 102 is simply referred to as an air pressure changing rate.

The air pressure changing rate of the 2-step control pattern 210 in "the first period" is represented by an absolute value of a slope of a straight line connecting the point X and the point Z, and the air pressure changing rate of the 2-step control pattern 210 in "the second period" is represented by an absolute value of a slope of a straight line connecting the point Z and the point Y.

Further, the air pressure changing rate of the 2-step control pattern 210 in "the first period" is larger than the maximum value of the air pressure changing rate of the uncontrolled pattern 201 and the air pressure changing rate of the constant changing pattern 203.

The maximum value of the air pressure changing rate of the uncontrolled pattern 201 corresponds to the maximum value of a slope of the uncontrolled pattern 201 and the air pressure changing rate of the constant changing pattern 203 corresponds to a slope of the constant changing pattern 203.

Further, the 2-step control pattern 210 shows, as the air pressure changing rate in "the first period", the maximum air pressure changing rate at which the air pressure in the elevator car 102 can be changed, or the air pressure changing rate being close to the maximum air pressure changing rate. It is possible to decide the maximum air pressure changing rate at which the air pressure in the elevator car 102 can be changed by performance of each equipment such as air pressure increasing/decreasing performance of the air pressure adjusting device 105 or the pressure resistant performance of the elevator car 102 and so on.

However, the maximum air pressure changing rate should have an upper limit within an extent that does not add excessive load to the tympanic membrane. Further, the maximum air pressure changing rate does not need to be set to the air pressure changing rate of the 2-step control pattern 210 in "the first period".

For example, the air pressure changing rate of the 2-step control pattern 210 in "the first period" shows the air pressure change around 1500 Pa to 3000 Pa per 10 seconds.

Further, in the 2-step control pattern 210, the time width (time length) of "the first period" is shorter than the time width of "the second period".

Further, the 2-step control pattern 210 shows, as the time length of "the first period", a time length required by the elevator car 102 for reaching the maximum speed after the elevator car 102 starts moving before arriving at the arrival floor.

However, the time length of "the first period" of the 2-step control pattern 210 does not need to satisfy these conditions.

The time length of "the first period" is decided as a time length required for changing with the air pressure changing amount of "the first period" at the air pressure changing rate of "the first period".

For example, when the descending height difference of the elevator car 102 is 300 m, the maximum speed of the elevator car 102 is 600 m/min. and the acceleration and deceleration of the elevator car 102 is 1.1 $m/s^2$, the time required by the elevator car 102 for arriving at the arrival floor after the elevator car 102 departs from the departure floor is around 39 seconds, and the time required by the elevator car 102 for reaching the maximum speed is around 9 seconds. Here, if the air pressure changing amount of the 2-step control pattern 210 in "the first period" is 2400 Pa, and the air pressure changing rate of the 2-step control pattern 210 in "the first period" is 3000 Pa/10 sec., the time length required for "the first period" becomes 8 seconds, and the time length for "the second period" is remaining 31 seconds.

However, the air pressure changing rate of "the first period" can be decided by fixing the time length of "the first period" and dividing the air pressure changing amount of "the first time period" with the time length of "the first period". For example, if the time length of "the first period" is assumed to be 10 seconds for the air pressure changing amount of 2400 Pa, the air pressure changing rate of "the first period" becomes 2400 Pa/10 sec.

FIG. 5 is a graph showing a time when ear-closed feeling occurs by the 2-step control pattern 210 while the elevator car 102 is descending according to the first embodiment, which corresponds to FIG. 3.

FIG. 6 is a graph showing a time when ear-closed feeling occurs by the 2-step control pattern 210 while the elevator car 102 is ascending according to the first embodiment, which corresponds to FIG. 4.

Comparison between the time when the ear-closed feeling occurs by the 2-step control pattern 210 and the time when the ear-closed feeling occurs by the uncontrolled pattern 201 will be explained in the following with reference to FIGS. 5 and 6.

In FIGS. 5 and 6, "$P_2$" is an estimated value of the air pressure changing amount by which the passengers in the elevator car 102 open the Eustachian tube, and "$P_1$" is an estimated value of the air pressure changing amount by which the passengers in the elevator car 102 feel the ear-closed feeling. Hereinafter, $P_2$ is referred to as a Eustachian tube opening air pressure changing amount, and $P_1$ is referred to as an ear-closed feeling air pressure changing amount.

The Eustachian tube opening air pressure changing amount $P_2$ and the ear-closed feeling air pressure changing amount $P_1$ are optimal values obtained by experiment, etc.

Further, an air pressure obtained by changing the air pressure in the elevator car 102 with the ear-closed feeling air pressure changing amount $P_1$ is shown by a broken line as an ear-closed feeling air pressure 204 by which the passengers feel the ear-closed feeling, and an air pressure obtained by changing the air pressure in the elevator car 102 with the Eustachian tube opening air pressure changing amount $P_2$ is shown by a broken line as a Eustachian tube opening air pressure 205 by which the passengers resolve the ear-closed feeling by opening the Eustachian tube.

The passengers in the elevator car 102 feel discomfort feeling caused by the ear fullness during a period after the air pressure in the elevator car 102 reaches the ear-closed feeling air pressure 204 until the air pressure reaches the Eustachian tube opening air pressure 205.

In case of controlling the air pressure in the elevator car 102 using the 2-step control pattern 210, a time when the passengers feel the discomfort feeling caused by the ear fullness is represented by "$T_1$", and in case of using the uncontrolled pattern 201, a time when the passengers feel the discomfort feeling caused by the ear fullness is represented by "$T_0$". Hereinafter, $T_0$ and $T_1$ are referred to as ear-closed feeling time, respectively.

The 2-step control pattern 210 changes the air pressure in the elevator car 102 with the Eustachian tube opening air pressure changing amount $P_2$ at an air pressure changing rate being larger than the maximum value of the air pressure changing rate of the uncontrolled pattern 201 in "the first period". Because of this, the ear-closed feeling time $T_1$ of the 2-step control pattern 210 becomes shorter than the ear-closed feeling time $T_0$ of the uncontrolled pattern 201. In the same manner, since the air pressure changing rate of the 2-step control pattern 210 in "the first period" is larger than the air pressure changing rate of the constant changing pattern 203, the ear-closed feeling time $T_1$ of the 2-step control pattern 210 becomes shorter than the ear-closed feeling time of the constant changing pattern 203 (illustration omitted). Namely, by controlling the air pressure in the elevator car 102 using the 2-step control pattern 210, it is possible to reduce the time when the passengers feel the discomfort feeling caused by the ear fullness, and thus the discomfort feeling of the passengers can be eased.

Further, the 2-step control pattern 210 changes the air pressure in the elevator car 102 with the Eustachian tube opening air pressure changing amount $P_2$ in "the first period" which starts when the elevator car 102 departs from the departure floor. Because of this, during the time zone of "the second period", in particular, during the time zone when the elevator car 102 ascends/descends at the maximum speed, it is possible to suppress the passengers from feeling the ear-closed feeling, and thus it is possible to provide the elevator 100 with more comfortable ride to the passengers.

FIG. 7 is a graph showing the 2-step control pattern 210 when the elevator car 102 is descending according to the first embodiment, which corresponds to FIG. 3.

FIG. 8 is a graph showing the 2-step control pattern 210 when the elevator car 102 is ascending according to the first embodiment, which corresponds to FIG. 4.

When the air pressure control device 104 controls the air pressure adjusting device 105 according to the polygonal curved 2-step control pattern 210 which has been explained based on FIGS. 3 and 4, the air pressure in the elevator car 102 changes, in fact, like curved lines as shown by the 2-step control pattern 210 in FIGS. 7 and 8.

In FIGS. 7 and 8, the air pressure changing rate of the 2-step control pattern 210 in "the first period" is the average changing rate of the air pressure of the 2-step control pattern 210 in "the first period"; the air pressure changing rate of the 2-step control pattern 210 in "the second period" is the average changing rate of the air pressure of the 2-step control pattern 210 in "the second period".

In the first embodiment, the elevator 100 has been explained like the following.

In the elevator 100 having large vertical travel distance (elevating distance), since the air pressure in the elevator car 102 changes largely due to the ascending/descending, many passengers voluntarily ease discomfort feeling by ear clearing such as swallowing, etc. Then, the air pressure control device 104 of the elevator 100 appropriately adjusts the air pressure in the elevator car 102, thereby easing the discomfort feeling due to the ear fullness which occurs by the air pressure change accompanied to the ascending/descending of the elevator car 102. Further, by adjusting the air pressure so as to measure a timing for clearing the ear which is carried out by the passengers, the air pressure control device 104 provides relatively comfortable ride to the passengers.

The elevator 100 includes the air pressure adjusting device 105 for adjusting the air pressure in the elevator car 102, by decreasing or increasing the air pressure in the elevator car 102 while the elevator car 102 is ascending or descending, and the air pressure control device 104 for controlling the air pressure adjusting device 105.

By adjusting the air pressure in the elevator car 102, which changes due to the ascending/descending of the elevator car 102, it is possible to ease the discomfort feeling caused by the ear fullness which the passengers suffer.

Further, the air pressure control device 104 divides the time period after the elevator car 102 departs from the departure floor until the elevator car 102 arrives at the arrival floor into two including the first period and the second period; the air pressure control device 104 changes the air pressure in the elevator car 102 differently for the first period and the second period while the elevator car 102 is ascending or descending.

By making clear difference with two types of change, it is possible to ease totally the discomfort feeling due to the ear fullness which the passengers suffer.

By prompting the passengers to clear the ear with a clear timing, it is possible to largely reduce the discomfort feeling due to the ear fullness at other timings.

Further, the air pressure control device 104 changes the air pressure in the elevator car 102 using the 2-step control pattern 210 in which an average changing amount per unit time obtained by dividing the air pressure difference changed in the first period with the time length of the first period is larger than an average changing amount per unit time obtained by dividing the air pressure difference changed in the second period with the time length of the second period.

By largely changing the air pressure in the elevator car 102 at an initial stage when the elevator car 102 departs from the departure floor, it is possible to prompt the passengers to clear the ear by swallowing, etc. at an early stage.

By this operation, it is possible to reduce the time period after the passengers start feeling the ear fullness until the ear clearing is done, and thus it is possible to shorten the time when the passengers feel discomfort.

When the second period starts, since the change in the air pressure is small, the discomfort feeling due to the ear fullness felt by the passengers is small, and thus comfortable ride is provided.

Embodiment 2

In the first embodiment, the 2-step control pattern 210 which largely changes the air pressure in the elevator car 102 in the departure time zone (the first period) has been explained.

In the second embodiment, another 2-step control pattern 210 which largely changes the air pressure in the elevator car 102 in the arrival time zone (the second period) will be explained.

Hereinafter, items which are different from the first embodiment will be mainly explained; it is assumed that items about which the explanation is omitted are the same as the first embodiment.

The departure/arrival control unit 121 (an example of the first air pressure changing unit) makes the air pressure adjusting device 105 increase/decrease the air pressure in the elevator car 102 with a predetermined arrival air pressure changing amount in a time zone having a predetermined time length which terminates when the elevator car 102 arrives at the arrival floor (an arrival time zone, hereinafter).

The except departure/arrival control unit 122 (an example of the second air pressure changing unit) makes the air pressure adjusting device 105 increase/decrease the air pressure in the elevator car 102 with a predetermined except arrival air pressure changing amount in a time zone after the elevator car 102 departs from the departure floor and before the arrival time zone, namely, a time zone while the elevator car 102 is ascending/descending, excluding the arrival time zone (an except arrival time zone, hereinafter).

The arrival time zone (an example of the first time zone), the arrival air pressure changing amount (an example of the first air pressure changing amount), and the arrival air pressure changing rate (an example of the first air pressure changing rate) are shown by the 2-step control pattern 210. The arrival air pressure changing rate means an average changing rate of the air pressure in the elevator car 102 at the arrival time zone.

Further, the except arrival time zone (an example of the second time zone), the except arrival air pressure changing amount (an example of the second air pressure changing amount), and the except arrival air pressure changing rate (an example of the second air pressure changing rate) are shown by the 2-step control pattern 210. The except arrival air pressure changing rate means an average changing rate of the air pressure in the elevator car 102 at the except arrival time zone.

FIG. 9 is a graph showing the 2-step control pattern 210 when the elevator car 102 is descending according to the second embodiment, which corresponds to FIG. 3 of the first embodiment.

FIG. 10 is a graph showing the 2-step control pattern 210 when the elevator car 102 is ascending according to the second embodiment, which corresponds to FIG. 4 of the first embodiment.

A detail of the 2-step control pattern 210 according to the second embodiment will be explained in the following with reference to FIGS. 9 and 10.

"The second period (an example of the first time zone)" shows the arrival time zone which is a time zone having a predetermined time length which terminates when the elevator car 102 arrives at the arrival floor, "the first period (an example of the second time zone)" is the except arrival time zone which is a time zone after the elevator car 102 departs from the departure floor before the arrival time zone.

"The second period (the first time zone, the arrival time zone)" of the 2-step control pattern 210 according to the second embodiment has the same features as the "the first period (the first time zone, the departure time zone)" of the 2-step control pattern 210 according to the first embodiment.

In the 2-step control pattern 210, the air pressure changing amount in "the second period" (an example of the first air pressure changing amount, the arrival air pressure changing amount) is larger than the air pressure changing amount in "the first period" (an example of the second air pressure changing amount, the except arrival air pressure changing amount).

Further, in "the second period", the air pressure changing amount of the 2-step control pattern 210 is larger than the air pressure changing amount of the uncontrolled pattern 201, and larger than the air pressure changing amount of the constant changing pattern 203.

In "the second period", the air pressure changing amount of the 2-step control pattern 210 is represented by an absolute value of the air pressure difference of the point Z and the point Y; the air pressure changing amount of the uncontrolled pattern 201 is represented by an absolute value of the air pressure difference of the point W and the point Y; and the air pressure changing amount of the constant changing pattern 203 is represented by an absolute value of the air pressure difference of the point V and the point Y.

Further, the 2-step control pattern 210 shows an estimated value of the air pressure changing amount by which the passengers in the elevator car 102 start feeling the ear-closed feeling as the air pressure changing amount in "the first period".

However, the estimated value of the air pressure changing amount by which the passengers start feeling the ear-closed feeling does not need to be set to the air pressure changing amount of the 2-step control pattern 210 in "the first period". For example, a value being smaller than the estimated value of the air pressure changing amount by which the passengers start feeling the ear-closed feeling can be set to the air pressure changing amount of the 2-step control pattern 210 in "the first period".

Further, the 2-step control pattern 210 shows a value obtained by subtracting the air pressure changing amount in "the first period" from the absolute value of the air pressure difference between the point X and the point Y (total air pressure changing amount) as the air pressure changing amount in "the second period".

The air pressure changing amount of the 2-step control pattern 210 in "the second period" according to the second embodiment can show, as well as the air pressure changing amount of the 2-step control pattern 210 in "the first period" according to the first embodiment, a value being no less than the estimated value of the air pressure changing amount by which the passengers open the Eustachian tubes multiple times.

Further, in the 2-step control pattern 210, the air pressure changing rate in "the second period" (an example of the first air pressure changing rate, the arrival air pressure changing rate) is larger than the air pressure changing rate in "the first period" (an example of the second air pressure changing rate, the except arrival air pressure changing rate).

Further, the air pressure changing rate of the 2-step control pattern 210 in "the second period" is larger than the maximum value of the air pressure changing rate of the uncontrolled pattern 201 and the air pressure changing rate of the constant changing pattern 203.

Further, the 2-step control pattern 210 shows, as the air pressure changing rate in "the second period", the maximum air pressure changing rate at which the air pressure in the elevator car 102 can be changed, or the air pressure changing rate being close to the maximum air pressure changing rate.

However, the maximum air pressure changing rate should have an upper limit within an extent that does not add excessive load to the tympanic membrane. Further, the maximum air pressure changing rate does not need to be set to the air pressure changing rate of the 2-step control pattern 210 in "the first period".

Further, in the 2-step control pattern 210, the time width (time length) of "the second period" is shorter than the time width of "the first period".

Further, the 2-step control pattern 210 shows, as the time length of "the second period", the time length required by the elevator car 102 for stopping after the elevator car 102 starts decelerating from the maximum speed.

However, the time length of "the second period" of the 2-step control pattern 210 does not need to satisfy these requirements.

The time length of "the second period" is decided as the time length required for changing with the air pressure changing amount of "the second period" at the air pressure changing rate of "the second period".

However, the air pressure changing rate of "the second period" can be defined to be a value obtained by fixing the time length of "the second period" and dividing the air pressure changing amount of "the second period" with the time length of "the second period".

FIG. 11 is a graph showing a time when the ear-closed feeling occurs by the 2-step control pattern 210 while the elevator car 102 is descending according to the second embodiment, which corresponds to FIG. 9 and FIG. 5 of the first embodiment.

FIG. 12 is a graph showing a time when the ear-closed feeling occurs by the 2-step control pattern 210 while the elevator car 102 is ascending according to the second embodiment, which corresponds to FIG. 10 and FIG. 6 of the first embodiment.

In FIGS. 11 and 12, an ear-closed feeling time $T_1$ of the 2-step control pattern 210 is shorter than an ear-closed feeling time $T_0$ of the uncontrolled pattern 201 as well as the first embodiment, and also is shorter than the ear-closed feeling time (illustration omitted) of the constant changing pattern 203. Namely, the air pressure in the elevator car 102 is controlled by the 2-step control pattern 210, and thereby reducing the time when the passengers feel discomfort feeling caused by the ear fullness, and thus the discomfort feeling of the passengers can be eased.

Further, in "the first period", the 2-step control pattern 210 changes only up to the ear-closed feeling air pressure $P_1$, and then "the second period" starts after the elevator car 102 starts decelerating. Because of this, in the time zone of "the first period", in particular, in the time zone when the elevator car 102 ascends/descends at the maximum speed, the passengers are suppressed from feeling the ear-closed feeling, and thus the elevator 100 with more comfortable ride can be provided to the passengers.

FIG. 13 is a graph showing the 2-step control pattern 210 when the elevator car 102 is descending according to the second embodiment, which corresponds to FIG. 9 and FIG. 7 of the first embodiment.

FIG. 14 is a graph showing the 2-step control pattern 210 when the elevator car 102 is ascending according to the second embodiment, which corresponds to FIG. 10 and FIG. 8 of the first embodiment.

When the air pressure control device 104 controls the air pressure adjusting device 105 according to the 2-step control pattern 210 which has been explained above, the air pressure in the elevator car 102 changes, in fact, on curved lines as shown by the 2-step control pattern 210 in FIGS. 13 and 14.

In the second embodiment, the following air pressure control apparatus 104 has been explained.

The air pressure control device 104 changes the air pressure in the elevator car 102 using the 2-step control pattern 210 in which the average changing amount per unit time obtained by dividing the air pressure difference changed in the first period with the time length of the first period is smaller than the average changing amount per unit time obtained by dividing the air pressure difference changed in the second period with the time length of the second period.

The air pressure is largely changed before the elevator car 102 arrives at the arrival floor, thereby prompting the passengers to clear the ear by the swallowing, etc.

By this operation, it is possible to reduce the time after the passengers start feeling the ear fullness until the passengers clear the ear; that is, the time period when the passengers feel discomfort can be shortened.

Since the changed air pressure is small in the first period, the discomfort feeling caused by the ear fullness felt by the passengers can be reduced, and thus comfortable ride can be provided.

Embodiment 3

In the first and second embodiments, the 2-step control pattern 210 by which the air pressure in the elevator car 102 is changed with two steps of the first period and the second period has been explained.

In the third embodiment, a 3-step control pattern 220 by which the air pressure in the elevator car 102 is changed with three steps of the first period, the second period, and the third period will be explained.

For example, the vertical travel distance of the elevator car 102 is large, and the passengers open the Eustachian tubes twice while the elevator car 102 is ascending/descending, according to the third embodiment, the Eustachian tubes are made open once respectively in the first period and the third period.

In the following, items being different from the first and the second embodiments will be mainly explained, and items for which explanation is omitted are assumed to be the same as the first and second embodiment.

FIG. 15 is a functional configuration diagram of an air pressure control device 104 according to the third embodiment.

The functional configuration of the air pressure control device 104 according to the third embodiment will be explained with reference to FIG. 15 in the following.

The air pressure control device 104 includes a 3-step control unit 130.

The 3-step control unit 130 (3-step air pressure changing unit) controls the air pressure adjusting device 105 according to a predetermined 3-step control pattern 220, thereby decreasing the air pressure in the ascending elevator car 102 with three steps, and as well increasing the air pressure in the descending elevator car 102 with three steps.

The 3-step control unit 130 includes a departure control unit 131 (an example of the first air pressure changing unit) which makes the air pressure adjusting device 105 increase/decrease the air pressure in the elevator car 102 with a predetermined departure air pressure changing amount in the departure time zone.

Further, the 3-step control unit 130 includes an arrival control unit 133 (an example of the third air pressure changing unit) which makes the air pressure adjusting device 105 increase/decrease the air pressure in the elevator car 102 with a predetermined arrival air pressure changing amount in the arrival time zone.

Further, the 3-step control unit 130 includes an intermediate control unit 132 (an example of the second air pressure changing unit) which makes the air pressure adjusting device 105 increase/decrease the air pressure in the elevator car 102 with a predetermined intermediate air pressure changing amount in a time zone after the departure time zone and before the arrival time zone, namely, a time zone during the ascending/descending of the elevator car 102 excluding the departure time zone and the arrival time zone (an intermediate time zone, hereinafter).

The departure time zone (an example of the first time zone), the departure air pressure changing amount (an example of the first air pressure changing amount), and the departure air pressure changing rate (an example of the first air pressure changing rate) are shown by the 3-step control pattern 220.

Further, the intermediate time zone (an example of the second time zone), an intermediate air pressure changing amount (an example of the second air pressure changing amount), and an intermediate air pressure changing rate (an example of the second air pressure changing rate are shown by the 3-step control pattern 220. The intermediate air pressure changing rate means an average changing rate of the air pressure in the elevator car 102 in the intermediate time zone.

Further, the arrival time zone (an example of the third time zone), the arrival air pressure changing amount (an example of the third air pressure changing amount), and the arrival air pressure changing rate (an example of the third air pressure changing rate) are shown by the 3-step control pattern 220.

As well as the 2-step control pattern 210, the 3-step control pattern 220 includes the 3-step control pattern 220 used for the descending elevator car 102 and the 3-step control pattern 220 used for the ascending elevator car 102.

FIG. 16 is a graph showing the 3-step control pattern 220 when the elevator car 102 is descending according to the third embodiment, which corresponds to FIG. 3 of the first embodiment and FIG. 9 of the second embodiment.

FIG. 17 is a graph showing the 3-step control pattern 220 when the elevator car 102 is ascending according to the third embodiment, which corresponds to FIG. 4 of the first embodiment and FIG. 10 of the second embodiment.

A detail of the 3-step control pattern 220 for easing the ear-closed feeling of the passengers in the elevator car 102 will be explained with reference to FIGS. 16 and 17 in the following.

The 3-step control pattern 220 shows that the air pressure in the elevator car 102 is changed with three steps of "the first period", "the second period", and "the third period". The 3-step control pattern 220 increases the air pressure in the elevator car 102 in "the first period", "the second period", and "the third period" in FIG. 16 when the elevator car 102 is descending, and the 3-step control pattern 220 decreases the air pressure in the elevator car 102 in "the first period", "the second period", and "the third period" in FIG. 17 when the elevator car 102 is ascending.

"The first period (an example of the first time zone)" shows the departure time zone having a predetermined length which starts when the elevator car 102 departs from the departure floor, "the third period (an example of the third time zone)" shows the arrival time zone having a predetermined length which terminates when the elevator car 102 arrives at the arrival floor, and "the second period (an example of the second time zone)" shows the intermediate time zone which is a time zone after the departure time zone and before the arrival time zone.

"The first period" in the third embodiment corresponds to "the first period" in the first embodiment, and "the third period" in the third embodiment corresponds to "the second period" in the second embodiment.

In the 3-step control pattern 220, the air pressure changing amount in "the first period" (an example of the first air pressure changing amount, the departure air pressure changing amount) and the air pressure changing amount in "the third period" (an example of the third air pressure changing amount, the arrival air pressure changing amount) are larger than the air pressure changing amount in "the second period" (an example of the second air pressure changing amount, the intermediate air pressure changing amount).

Further, in "the first period" and "the third period", the air pressure changing amount of the 3-step control pattern 220 is larger than the air pressure changing amount of the uncontrolled pattern 201 and larger than the air pressure changing amount of the constant changing pattern 203.

In "the first period", the air pressure changing amount of the 3-step control pattern 220 is represented by an absolute value of the air pressure difference between the point X and the point $Z_1$; the air pressure changing amount of the uncontrolled pattern 201 is represented by an absolute value of the air pressure difference between the point X and the point $W_1$; and the air pressure changing amount of the constant changing pattern 203 is represented by an absolute value of the air pressure difference between the point X and the point $V_1$.

Further in "the second period", the air pressure changing amount of the 3-step control pattern 220 is represented by an absolute value of the air pressure difference between the point $Z_1$ and the point $Z_2$; the air pressure changing amount of the uncontrolled pattern 201 is represented by an absolute value of the air pressure difference between the point $W_1$ and the point $W_2$; and the air pressure changing amount of the constant changing pattern 203 is represented by an absolute value of the air pressure difference between the point $V_1$ and the point $V_2$.

Further in "the third period", the air pressure changing amount of the 3-step control pattern 220 is represented by an absolute value of the air pressure difference between the point $Z_2$ and the point Y; the air pressure changing amount of the uncontrolled pattern 201 is represented by an absolute value of the air pressure difference between the point $W_2$ and the point Y; and the air pressure changing amount of the constant changing pattern 203 is represented by an absolute value of the air pressure difference between the point $V_2$ and the point Y.

Further, the 3-step control pattern 220 shows an estimated value of the air pressure changing amount by which the passengers open the Eustachian tubes as the air pressure changing amount in "the first period", an estimated value of the air pressure changing amount which has been changed after the passengers open the Eustachian tubes until the passengers start feeling the ear-closed feeling as the air pressure changing amount in "the second period", and a value obtained by subtracting the air pressure changing amount in "the first period" and the air pressure changing amount in "the second period" from an absolute value (total air pressure changing amount) of the air pressure difference between the point X and the point Y as the air pressure changing amount in "the third period".

The air pressure changing amount of "the first period" and the air pressure changing amount of "the third period" in the 3-step control pattern 220 according to the third embodiment can show a value being no less than an estimated value of the air pressure changing amount by which the passengers open the Eustachian tubes multiple times as well as the air pressure changing amount of "the first period" of the 2-step control pattern 210 in the first embodiment and the air pressure changing amount of "the second period" of the 2-step control pattern 210 in the second embodiment.

Further, in the 3-step control pattern 220, the air pressure changing rate in "the first period" (an example of the first air pressure changing rate; the departure air pressure changing rate) and the air pressure changing rate in "the third period" (an example of the third air pressure changing rate; the arrival air pressure changing rate) are larger than the air pressure changing rate in "the second period" (an example of the second air pressure changing rate; the intermediate air pressure changing rate).

The air pressure changing rate in "the first period" of the 3-step control pattern 220 is represented by an absolute value of a slope of a straight line connecting between the point X and the point $Z_1$, the air pressure changing rate in "the second period" of the 3-step control pattern 220 is represented by an absolute value of a slope of a straight line connecting between the point $Z_1$ and the point $Z_2$, and the air pressure changing rate in "the third period" of the 3-step control pattern 220 is represented by an absolute value of a slope of a straight line connecting between the point $Z_2$ and the point Y.

Further, the air pressure changing rates in "the first period" and "the third period" of the 3-step control pattern 220 are larger than the maximum value of the air pressure changing rate of the uncontrolled pattern 201 and the air pressure changing rate of the constant changing pattern 203.

Further, the 3-step control pattern 220 shows the maximum air pressure changing rate at which the air pressure in the elevator car 102 can be changed or an air pressure changing rate being close to the maximum air pressure changing rate as the air pressure changing rate in "the first period" and the air pressure changing rate in "the third period".

However, the maximum air pressure changing rate should have an upper limit within an extent that does not add excessive load to the tympanic membrane. Further, the maximum air pressure changing rate does not need to be set to the air pressure changing rate of the 3-step control pattern 220 in "the first period" and "the third period".

Further, in the 3-step control pattern 220, the time width of "the first period" and the time width of "the third period" are shorter than the time width of "the second period".

Further, the 3-step control pattern 220 shows a time length required by the elevator car 102 for reaching the maximum speed after the elevator car 102 starts moving before arriving at the arrival floor as the time length of "the first period", and a time length required by the elevator car 102 for stopping after the elevator car 102 starts decelerating from the maximum speed as the time length of "the third period".

However, the time length of "the first period" and the time length of "the third period" of the 3-step control pattern 220 do not need to satisfy these conditions.

The time length of "the first period" is decided as a time length required for changing with the air pressure changing amount of "the first period" at the air pressure changing rate in "the first period" and the time length of "the third period" is decided as a time length required for changing with the air pressure changing amount of "the third period" at the air pressure changing rate in "the third period".

However, the air pressure changing rate of "the first period" can be decided by fixing the time length of "the first period" and dividing the air pressure changing amount of "the first period" with the time length of "the first period", and the air pressure changing rate of "the third period" can be decided by fixing the time length of "the third period" and dividing the air pressure changing amount of "the third period" with the time length of "the third period".

FIG. 18 is a graph showing a time when the ear-closed feeling occurs by the 3-step control pattern 220 while the elevator car 102 is descending according to the third embodiment, which corresponds to FIG. 16, FIG. 5 of the first embodiment, and FIG. 11 of the second embodiment.

FIG. 19 is a graph showing a time when the ear-closed feeling occurs by the 3-step control pattern 220 while the elevator car 102 is ascending according to the third embodiment, which corresponds to FIG. 17, FIG. 6 of the first embodiment, and FIG. 12 of the second embodiment.

In FIGS. 18 and 19, "$P_4$" is an estimated value of the air pressure changing amount which has been changed after the passengers open the Eustachian tubes until the passengers open the Eustachian tubes again, "$P_3$" is an estimated value of the air pressure changing amount which has been changed after the passengers open the Eustachian tubes until the passengers feel the ear-closed feeling again. Hereinafter, $P_4$ is referred to as a Eustachian tube opening air pressure changing amount and $P_3$ is referred to as an ear-closed feeling air pressure changing amount.

The Eustachian tube opening air pressure changing amount $P_4$ and the ear-closed feeling air pressure changing amount $P_3$ are the optimal values obtained by experiments, etc.

A first ear-closed feeling time $T_{11}$ and a second ear-closed feeling time $T_{12}$ of the 3-step control pattern 220 are respectively shorter than a first ear-closed feeling time $T_{01}$ and a second ear-closed feeling time $T_{01}$ of the uncontrolled pattern 201. Further, the first ear-closed feeling time $T_{11}$ and the second ear-closed feeling time $T_{12}$ of the 3-step control pattern 220 are respectively shorter than a first ear-closed feeling time (illustration omitted) and a second ear-closed feeling time (illustration omitted) of the constant changing pattern 203. Namely, by controlling the air pressure in the elevator car 102 with the 3-step control pattern 220, the time when the passengers feel the discomfort feeling caused by the ear fullness can be shortened and the discomfort feeling of the passengers can be eased.

Further, the 3-step control pattern 220 suppresses the ear-closed feeling felt by the passengers in the time zone of "the second period", in particular in the time zone when the elevator car 102 ascends/descends at the maximum speed as well as the first and second embodiments, so that it is possible to provide the elevator 100 with more comfortable ride to the passengers.

FIG. 20 is a graph showing the 3-step control pattern 220 when the elevator car 102 is descending according to the third embodiment, which corresponds to FIG. 16, FIG. 7 of the first embodiment, and FIG. 13 of the second embodiment.

FIG. 21 is a graph showing the 3-step control pattern 220 when the elevator car 102 is ascending according to the third embodiment, which corresponds to FIG. 17, FIG. 8 of the first embodiment, and FIG. 14 of the second embodiment.

When the air pressure control device 104 controls the air pressure adjusting device 105 according to the 3-step control pattern 220 which has been explained above, the air pressure in the elevator car 102 changes, in face, on curved lines as shown by the 3-step control pattern 220 in FIGS. 20 and 21.

In the third embodiment, the air pressure control device 104 like the following has been explained.

The air pressure control device 104 divides the time period after the elevator car 102 departs from the departure floor until arriving at the arrival floor into three of "the first period", "the second period", and "the third period"; the air pressure control device 104 changes the air pressure in the elevator car 102 during ascending or descending differently for "the first period", "the second period", and "the third period".

By clearly differentiating with three kinds of changes, it is possible to totally ease the discomfort feeling caused by the ear fullness given to the passengers.

Timing to prompt the passengers to clear the ear is made distinct, and thereby it is possible to largely reduce the discomfort feeling caused by the ear fullness at other timings.

The air pressure control device 104 changes the air pressure in the elevator car 102 using the 3-step control pattern 220 in which an average changing amount per unit time obtained by dividing the air pressure difference changed in "the second period" with the time length of "the second period" is smaller than an average changing amount obtained by dividing the air pressure difference changed in "the first period" with the time length of "the first period" and an average changing amount obtained by dividing the air pressure difference changed in "the third period" with the time length of "the third period".

In case of the elevator with high elevating distance, the passengers may clear the ears at least twice. The air pressure is largely changed just after departing from the departure floor ("the first period") and just before arriving at the arrival floor ("the third period"), thereby prompting the passengers to clear the ear by swallowing, etc.; and further the air pressure changing amount of the intermediate part ("the second period") is made small, thereby easing the discomfort feeling caused by the ear fullness of the passengers.

By this operation, the time period after the passengers start feeling the ear fullness until clearing the ear is reduced, so that it is possible to shorten the time when the passengers feel discomfort.

Embodiment 4

In the fourth embodiment, an air pressure control device 104 will be explained, which controls the air pressure in the elevator car 102 using the 2-step control pattern 210 or the 3-step control pattern 220 according to a departure floor and an arrival floor between which the elevator 100 ascends/descends when the elevator 100 does not go up and down directly between particular departure and arrival floors, but ascends/descends between the departure and arrival floors specified by the passengers.

Hereinafter, items which are different from the first to third embodiments will be mainly explained; it is assumed that items about which the explanation is omitted are the same as at least one of the first to third embodiments.

The departure/arrival control unit 121 of the 2-step control unit 120 calculates the air pressure changing amount corresponding to the height difference between the departure floor specified by the passenger and the arrival floor specified by the passenger as the total air pressure changing amount, and the departure/arrival control unit 121 determines the 2-step control pattern 210 based on the calculated total air pressure changing amount.

For example, the departure/arrival control unit 121 which largely changes the air pressure in the elevator car 102 in the departure time zone explained in the first embodiment selects one 2-step control pattern 210 to be used out of plural 2-step control patterns 210.

The departure floor specified by the passenger means a floor for which the passenger pushes an UP call button or a DOWN call button on an operation board of the elevator boarding place 103, and the arrival floor specified by the passenger means a floor shown by a button on an operation board in the elevator car 102 pushed by the passenger who gets in the elevator car 102.

The departure/arrival control unit 121 inputs information of the departure floor specified by the passenger and the arrival floor specified by the passenger from the elevator control device 109.

Further, the departure/arrival control unit 121 obtains the air pressure of the departure floor and the air pressure of the arrival floor, and calculates an absolute value of the air pressure difference between the obtained air pressure of the departure floor and the air pressure of the arrival floor as the total air pressure changing amount. The air pressure of the departure floor and the air pressure of the arrival floor can be stored previously in a memory of the air pressure control device 104 as the air pressure at the height of each floor, or can be measured by a barometer provided at each floor.

Further, it is assumed that plural 2-step control patterns 210 are defined according to the total air pressure changing amount and stored in the memory of the air pressure control device 104.

For example, a 2-step control pattern A 211 to be used when the total air pressure changing amount is at least 2400 Pa and less than 3600 Pa, a 2-step control pattern B 212 to be used when the total air pressure changing amount is at least 3600 Pa and less than 4400 Pa, etc. are stored in the memory of the air pressure control device 104.

When the total air pressure changing amount is at least 2400 Pa and less than 3600 Pa, the departure/arrival control unit 121 controls the air pressure in the elevator car 102 via the air pressure adjusting device 105 using the 2-step control pattern A 211. Further, when the total air pressure changing amount is at least 3600 Pa and less than 4400 Pa, the departure/arrival control unit 121 controls the air pressure in the elevator car 102 via the air pressure adjusting device 105 using the 2-step control pattern B 212.

For example, 2400 Pa is set to the departure air pressure changing amount of the 2-step control pattern A 211, and 3600 Pa is set to the departure air pressure changing amount of the 2-step control pattern B 212. 2400 Pa shows an estimated value of the air pressure changing amount by which the passengers open the Eustachian tubes for the first time, and 3600 Pa shows an estimated value of the air pressure changing amount by which the passengers open the Eustachian tubes for the second time.

The departure/arrival control unit 121 changes the air pressure in the elevator car 102 based on the selected 2-step control pattern 210 with the departure air pressure changing amount in the departure time zone.

The except departure air pressure changing amount of the 2-step control pattern 210 is decided as a value obtained by subtracting the departure air pressure changing amount from the total air pressure changing amount. The except departure/arrival control unit 122 controls the air pressure in the elevator car 102 with the except departure air pressure changing amount after the departure time zone has passed.

Further, for example, as has been explained in the second embodiment, when the 2-step control unit 120 largely changes the air pressure in the elevator car 102 in the arrival time zone, one 2-step control pattern 210 is prepared, and in this 2-step control pattern 210, the except arrival air pressure changing amount and the arrival air pressure changing rate are set.

The departure/arrival control unit 121 calculates a value obtained by subtracting the except arrival air pressure changing amount from the total air pressure changing amount as the arrival air pressure changing amount, and calculates a value obtained by dividing the arrival air pressure changing amount with the arrival air pressure changing rate as the time length of the arrival time zone. Further, the except departure/arrival control unit 122 calculates a time required by the elevator car 102 for arriving at the arrival floor from the departure floor as the total elevating time based on the ascending/descending speed, the acceleration and the deceleration of the elevator car 102, and the height difference between the departure floor and the arrival floor. Then, the except departure/arrival control unit 122 calculates a time length obtained by subtracting the time length of the arrival time zone from the total elevating time as the time length of the except arrival time zone. At this time, the ascending/descending speed, the acceleration and deceleration of the elevator car 102, the height of each floor are previously stored in the memory of the air pressure control device 104.

The except departure/arrival control unit 122 changes the air pressure in the elevator car 102 with the except arrival air pressure changing amount during the time length of the except arrival time zone after the elevator car 102 starts ascending/descending, and the departure/arrival control unit 121 changes the air pressure in the elevator car 102 with the arrival air pressure changing amount during the time length of the arrival time zone after the except arrival time zone terminates.

Further, for example, the 2-step control pattern 210 is previously prepared for each combination of the departure floor and the arrival floor (or the number of floors of ascending/descending from the departure floor to the arrival floor), and the departure/arrival control unit 121 and the except departure/arrival control unit 122 may change the air pressure in the elevator car 102 according to the 2-step control pattern 210 corresponding to the combination of the departure floor and the arrival floor (or the number of floors of ascending/descending from the departure floor to the arrival floor) specified by the passengers.

The 3-step control unit 130, as well as the 2-step control unit 120, selects the 3-step control pattern 220 based on the total air pressure changing amount, calculates the time lengths of the departure time zone, the intermediate time zone, and the arrival time zone, the air pressure changing amount, and the air pressure changing rate based on the height difference between the departure and arrival floors, and further selects the 3-step control pattern 220 based on the combination of the departure floor and the arrival floor (or the number of floors of ascending/descending from the departure floor to the arrival floor). The 3-step control unit 130 changes the air pressure in the elevator car 102 according to the selected or calculated 3-step control pattern 220.

Further, the 2-step control unit 120, based on the departure floor and the arrival floor, can select either of the 2-step control pattern 210 by which the air pressure is largely changed in the departure time zone which has been explained in the first embodiment and the 2-step control pattern 210 by which the air pressure is largely changed in the arrival time zone which has been explained in the second embodiment. The 2-step control unit 120 changes the air pressure in the elevator car 102 according to the selected 2-step control pattern 210. In this case, the 2-step control pattern 210 is defined according to the total air pressure changing amount, the height difference between the departure floor and the arrival floor, the combination of the departure and arrival floors, or the number of floors of ascending/descending from the departure floor to the arrival floor.

By this operation, the air pressure control device 104 can change the air pressure in the elevator car 102 using the appropriate 2-step control pattern 210 or the appropriate 3-step control pattern 220 according to the departure floor and the arrival floor, and thus the air pressure control device 104 can provide the passengers with comfortable ride.

Embodiment 5

In the fifth embodiment, an air pressure control device 104 will be explained, which switches the 2-step control pattern 210 and the 3-step control pattern 220 according to a departure floor and an arrival floor between which the elevator 100 ascends/descends when the elevator 100 ascends/descends between the departure and arrival floors respectively specified by the passengers.

Hereinafter, items which are different from the first to fourth embodiments will be mainly explained; it is assumed that items about which the explanation is omitted are the same as at least one of the first to fourth embodiments.

FIG. 22 is a functional configuration diagram of an air pressure control device 104 according to the fifth embodiment.

The functional configuration of the air pressure control device 104 according to the fifth embodiment will be explained in the following with reference to FIG. 22. The air pressure control device 104 includes the 2-step control unit 120, the 3-step control unit 130, and a total air pressure changing amount determining unit 140.

The total air pressure changing amount determining unit 140 calculates an air pressure changing amount corresponding to the height difference between the departure floor and the arrival floor respectively specified by the passengers as a total air pressure changing amount, compares the total air pressure changing amount with a predetermined comparison changing amount, and determines the size of the total air pressure changing amount and the comparison changing amount.

The total air pressure changing amount determining unit 140 inputs information of the departure floor and the arrival floor respectively specified by the passengers from an elevator control device 109.

Further, the total air pressure changing amount determining unit 140 obtains the air pressure of the departure floor and the air pressure of the arrival floor, and calculates an absolute value of the air pressure difference between the air pressure of the departure floor and the air pressure of the arrival floor as the total air pressure changing amount.

Further, the comparison changing amount is previously defined and stored in a memory of the air pressure control device 104.

FIG. 23 is a flowchart showing an air pressure control method of the air pressure control device 104 according to the fifth embodiment.

The air pressure control method of the air pressure control device 104 according to the fifth embodiment will be explained in the following with reference to FIG. 23.

The 2-step control unit 120, the 3-step control unit 130, and the total air pressure changing amount determining unit 140 of the air pressure control device 104 carry out the processes which will be explained in the following using a CPU.

<S110: Total Air Pressure Changing Amount Calculating Process>

First, the total air pressure changing amount determining unit 140 calculates the total air pressure changing amount based on the departure floor and the arrival floor specified by the passengers.

<S120: First Determination Process of Total Air Pressure Changing Amount>

Next, the total air pressure changing amount determining unit 140 compares the total air pressure changing amount with the first comparison changing amount. The first comparison changing amount is a determination value for determining whether or not the air pressure control device 104 controls the air pressure in the elevator car 102, to which a predetermined air pressure changing amount is set. For example, to the first comparison changing amount, an estimated value of the air pressure changing amount by which the passengers open the Eustachian tubes for the first time is set.

If the total air pressure changing amount is determined to be smaller than the first comparison changing amount, the total air pressure changing amount determining unit 140 terminates the process. At this time, the air pressure control device 104 does not control the air pressure in the elevator car 102; the air pressure in the elevator car 102 changes by the uncontrolled pattern 201 according to the ascending/descending of the elevator car 102.

<S130: Second Determination Process of Total Air Pressure Changing Amount>

At S120, if the total air pressure changing amount is determined to be at least the first comparison changing amount, the total air pressure changing amount determining unit 140 compares the total air pressure changing amount with the second comparison changing amount. The second comparison changing amount is a determination value for determining whether the 2-step control unit 120 or the 3-step control unit 130 controls the air pressure, to which a predetermined air pressure changing amount is set. For example, an estimated value of the second air pressure changing amount by which the passengers open the Eustachian tubes for the second time is set to the second comparison changing amount.

<S140: 2-Step Air Pressure Control Process>

At S130, if the total air pressure changing amount is determined to be less than the second comparison changing amount, the 2-step control unit 120 controls the air pressure adjusting device 105 according to the 2-step control pattern 210 and changes the air pressure in the elevator car 102.

At this time, the 2-step control unit 120, as well as the fourth embodiment, specifies the 2-step control pattern 210 based on the departure floor and the arrival floor, and the 2-step control unit 120 changes the air pressure in the elevator car 102 according to the specified 2-step control pattern 210.

<S150: 3-Step Air Pressure Control Process>

At S130, if the total air pressure changing amount is determined to be at least the second comparison changing amount, the 3-step control unit 130 controls the air pressure adjusting device 105 according to the 3-step control pattern 220 and changes the air pressure in the elevator car 102.

At this time, the 3-step control unit 130, as well as the fourth embodiment, specifies the 3-step control pattern 220 based on the departure floor and the arrival floor, and the 3-step control unit 130 changes the air pressure in the elevator car 102 according to the specified 3-step control pattern 220.

In the above, it has been explained that based on the comparison result of the total air pressure changing amount and the comparison changing amount determined by the total air pressure changing amount determining unit 140, the air pressure control device 104 does not control, or carries out 2-step control, 3-step control of the air pressure in the elevator car 102.

However, the air pressure control device 104 can also switch non-control, 2-step control, or 3-step control without using the comparison result of the total air pressure changing amount and the comparison changing amount.

For example, it is possible to previously define which of non-control, 2-step control, and 3-step control should be selected based on the height difference between the departure floor and the arrival floor, the combination of the departure and arrival floors, or the number of floors of ascending/descending from the departure floor to the arrival floor.

By this operation, the air pressure control device 104 can appropriately select either of non-control, 2-step control, or 3-step control according to the departure floor and the arrival floor, and thus it is possible to provide the passengers with comfortable ride.

EXPLANATION OF SIGNS

Figure 1:
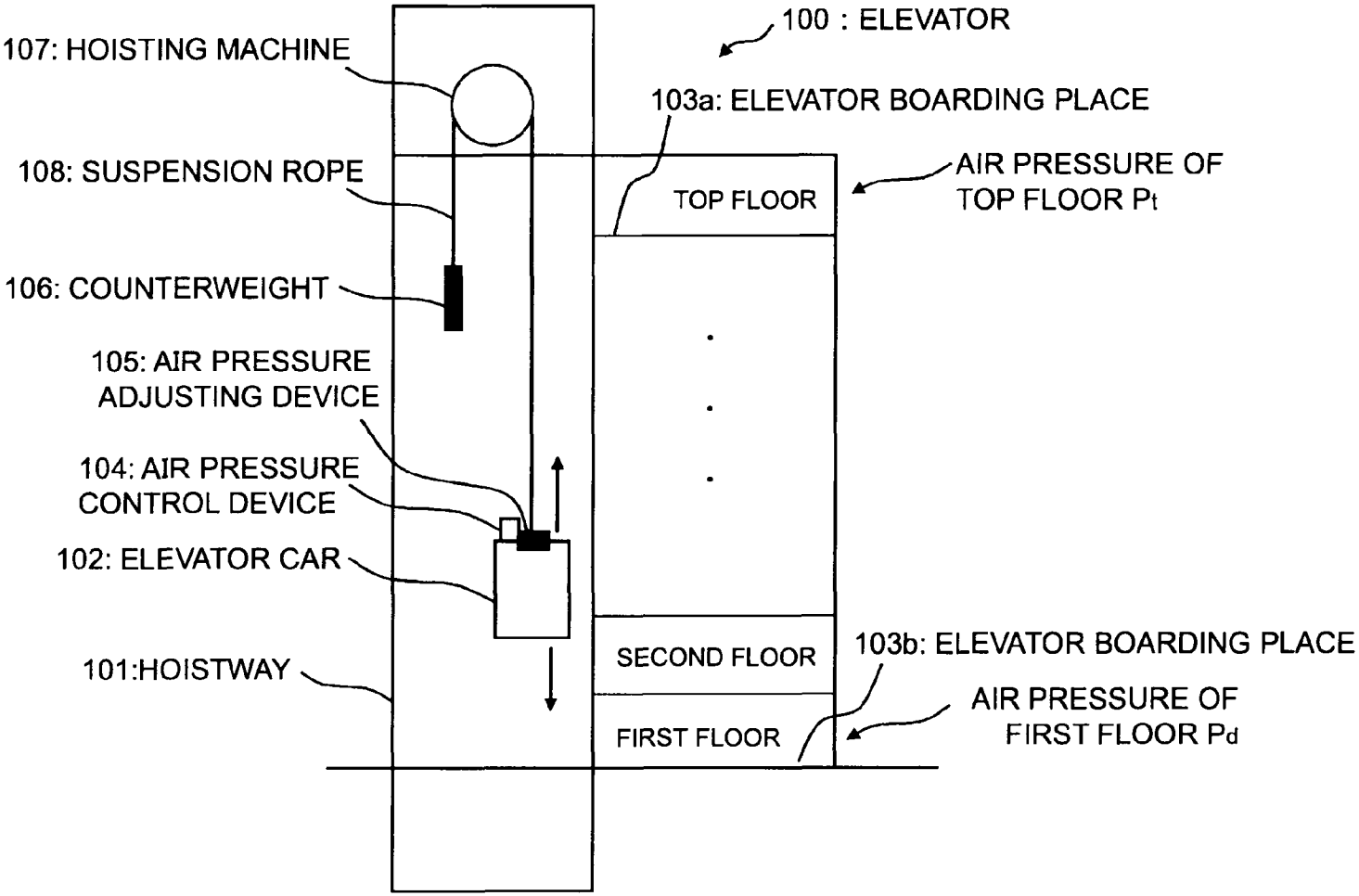
FIG. 1 is a configuration diagram of an elevator 100 according to the first embodiment.
Figure 2:
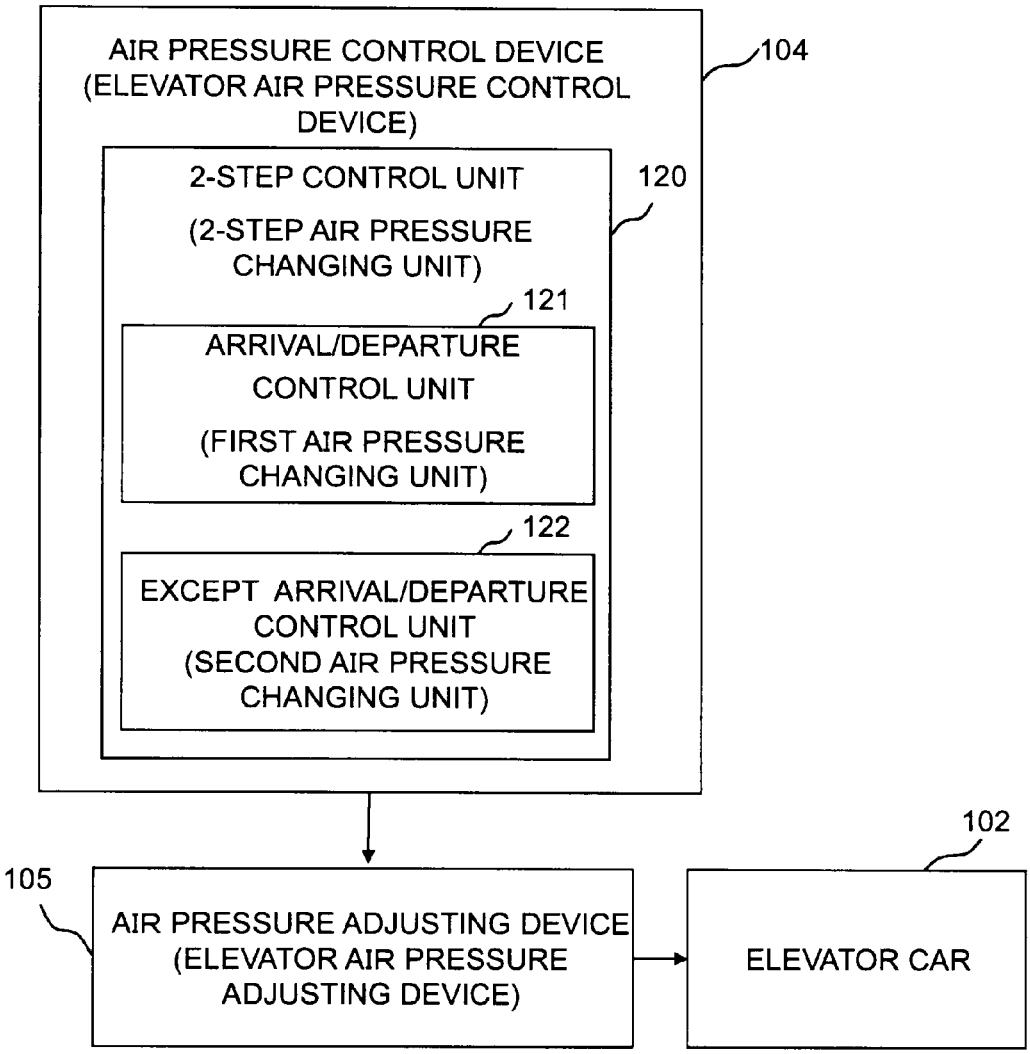
FIG. 2 is a functional configuration diagram of an air pressure control device 104 according to the first embodiment.
Figure 3:
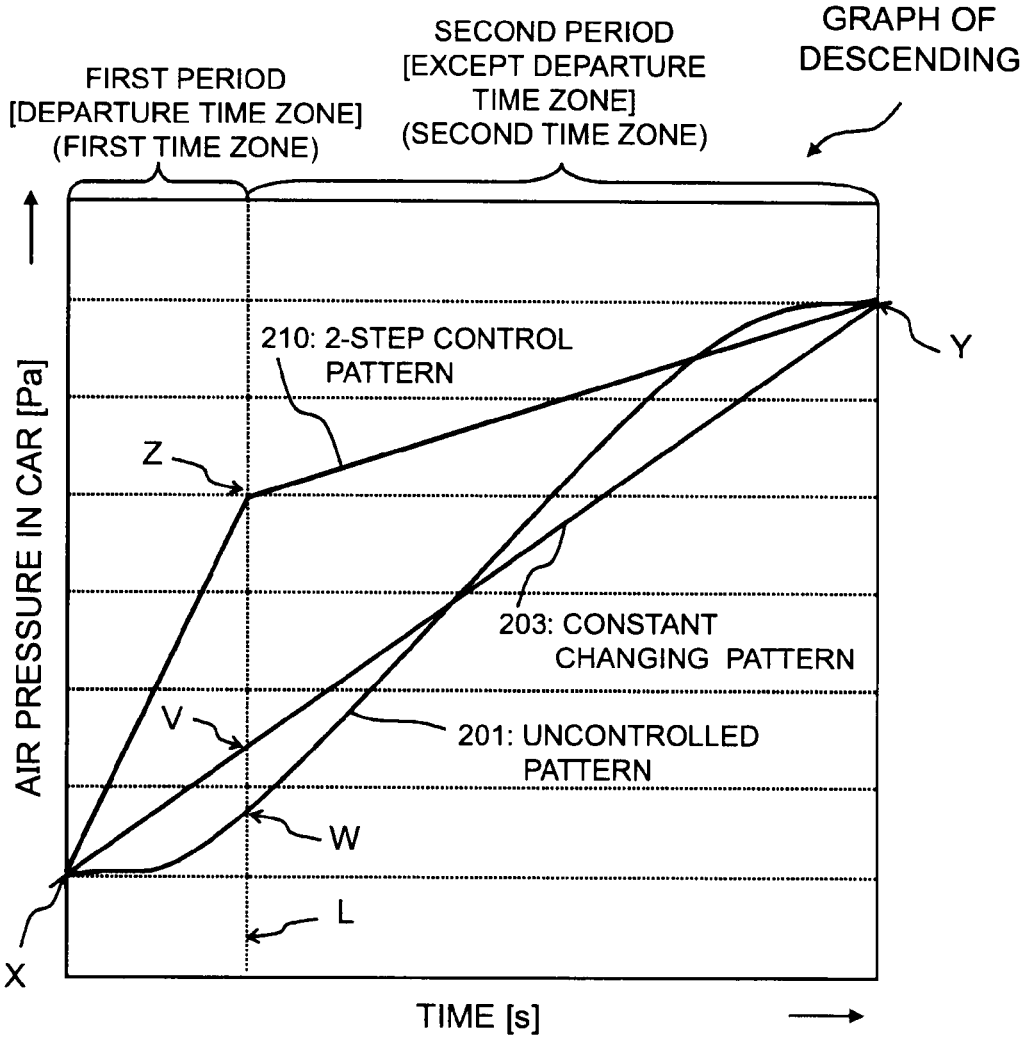
FIG. 3 is a graph showing a 2-step control pattern 210 when an elevator car 102 is descending according to the first embodiment.
Figure 4:
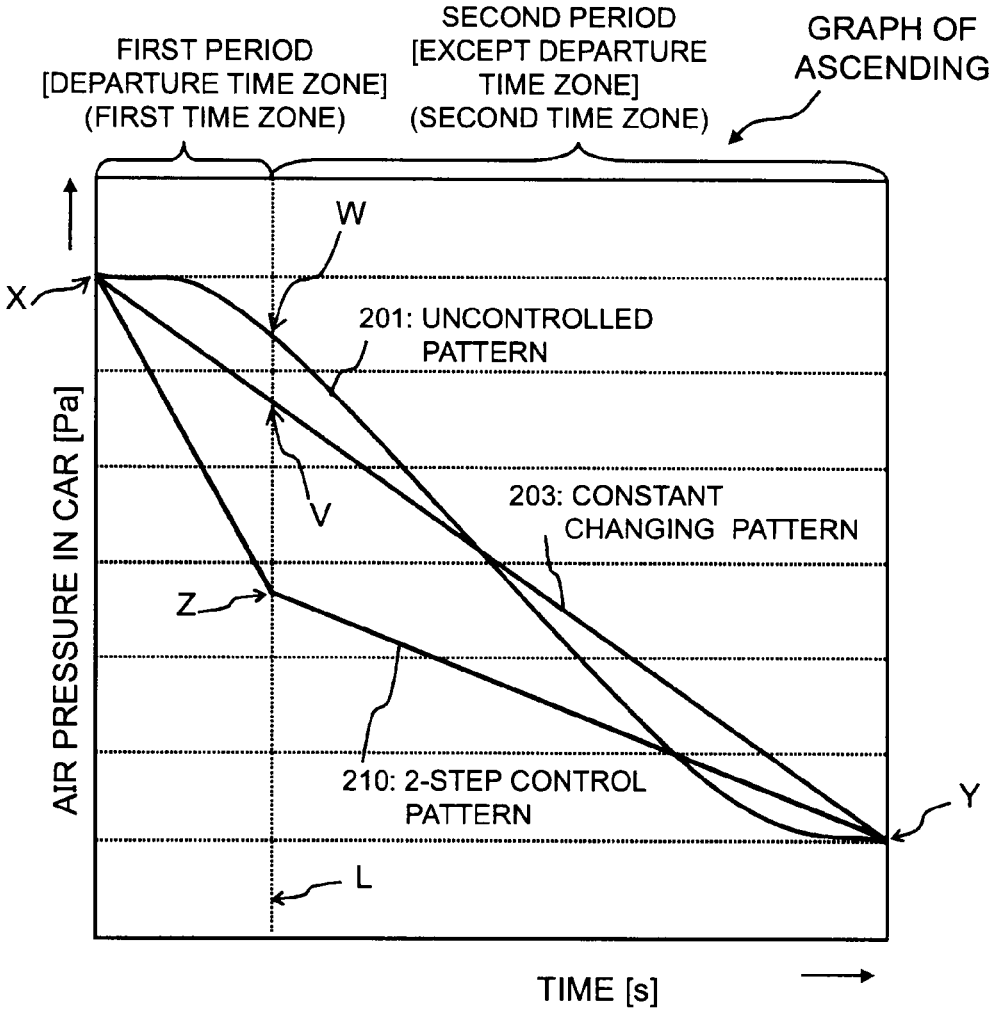
FIG. 4 is a graph showing the 2-step control pattern 210 when the elevator car 102 is ascending according to the first embodiment.
Figure 5:
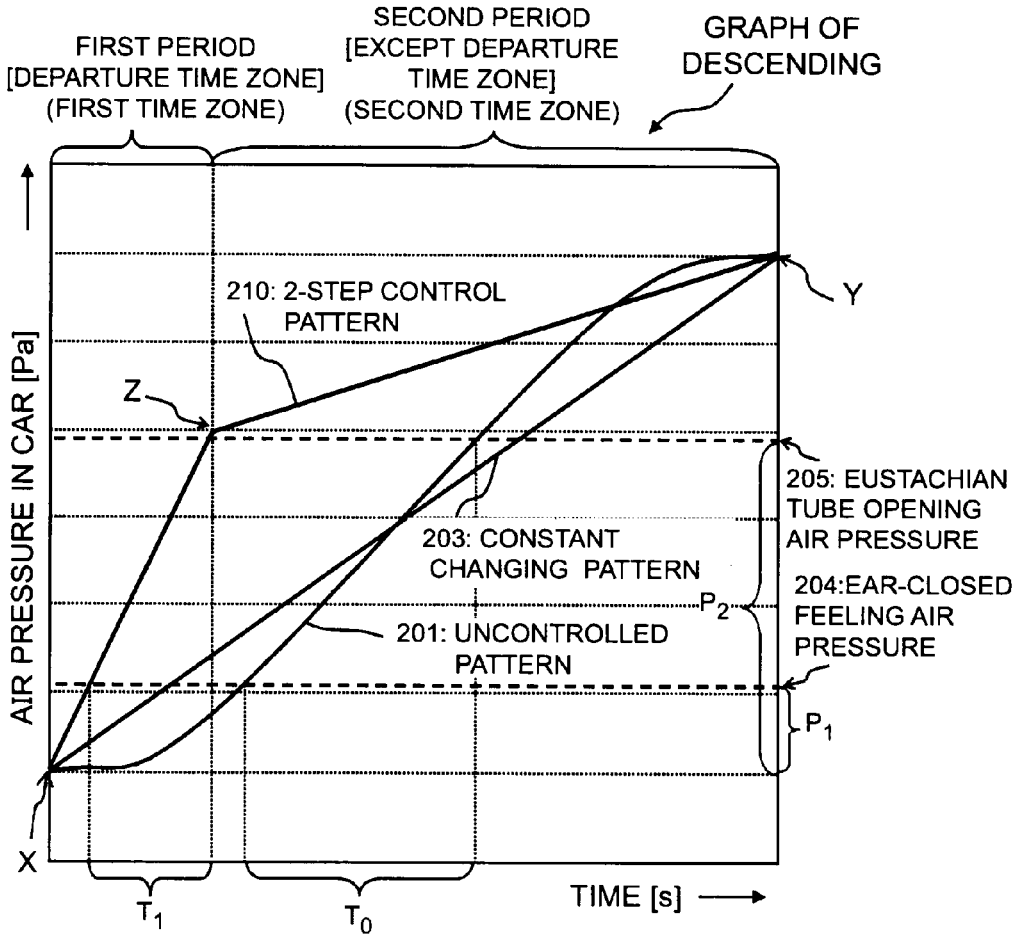
FIG. 5 is a graph showing a time when ear-closed feeling occurs by the 2-step control pattern 210 while the elevator car 102 is descending according to the first embodiment.
Figure 6:
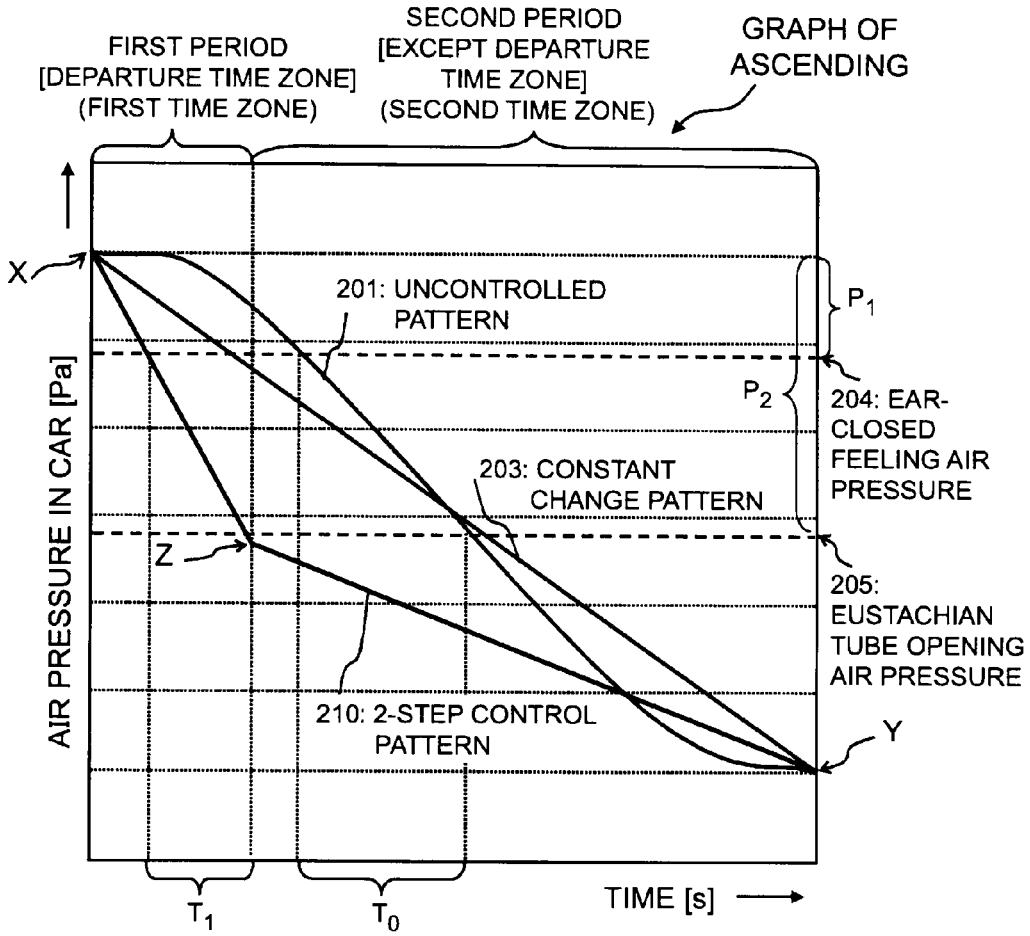
FIG. 6 is a graph showing a time when ear-closed feeling occurs by the 2-step control pattern 210 while the elevator car 102 is ascending according to the first embodiment.
Figure 7:
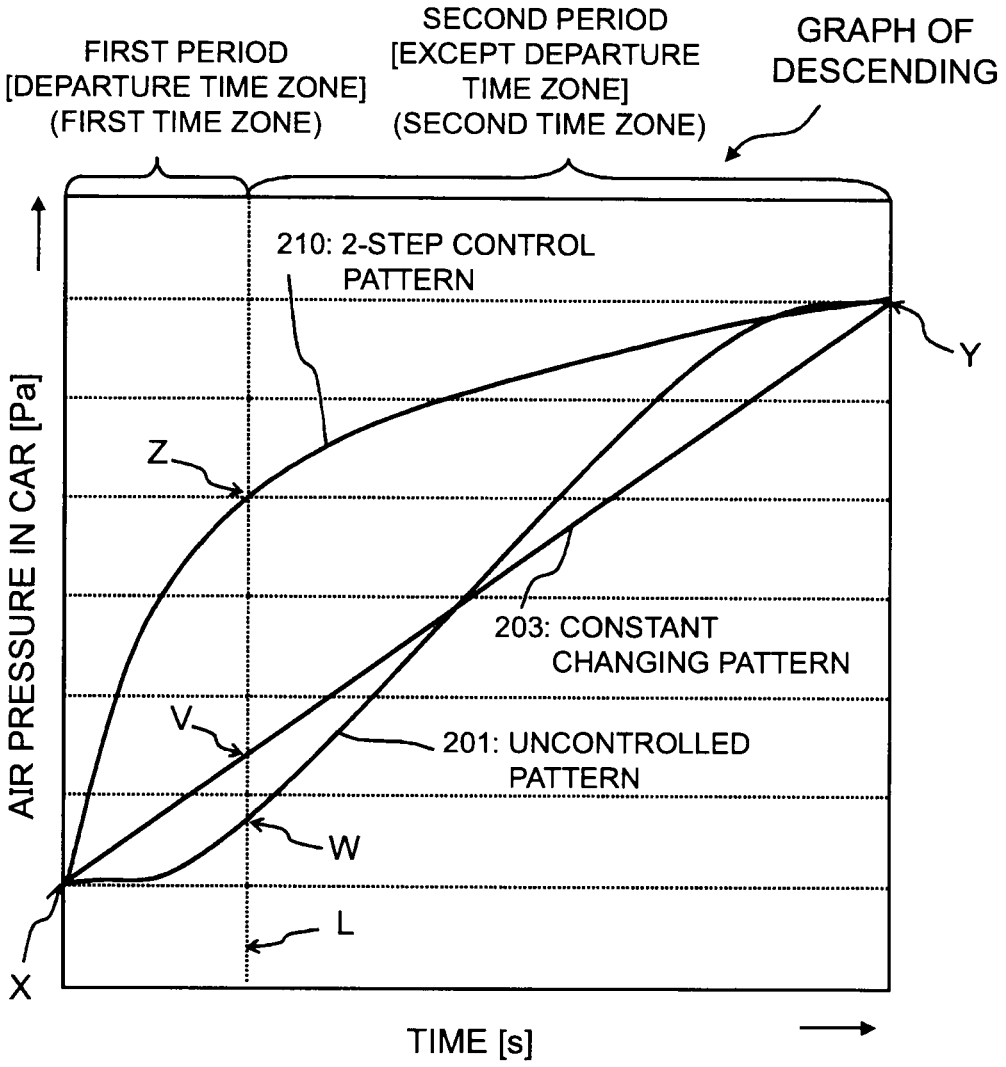
FIG. 7 is a graph showing the 2-step control pattern 210 when the elevator car 102 is descending according to the first embodiment.
Figure 8:
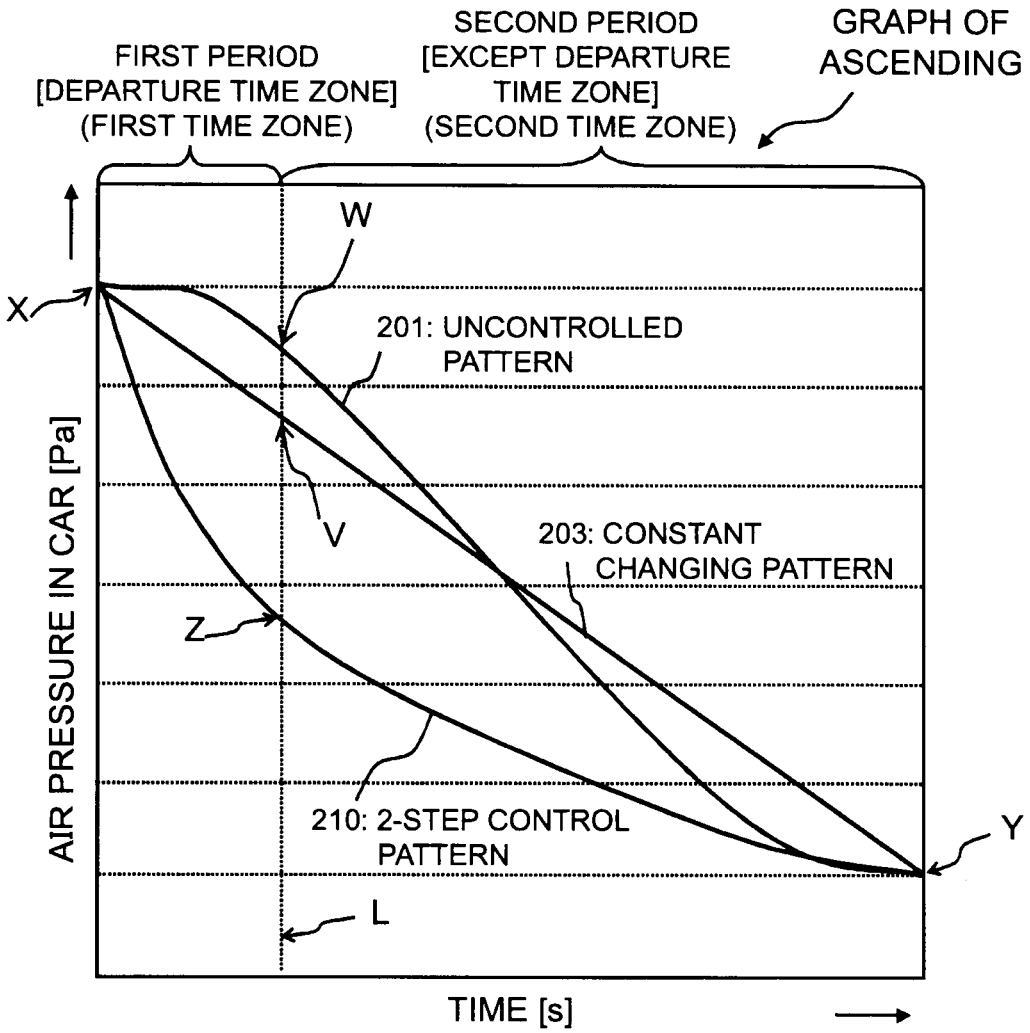
FIG. 8 a graph showing the 2-step control pattern 210 when the elevator car 102 is ascending according to the first embodiment.
Figure 9:
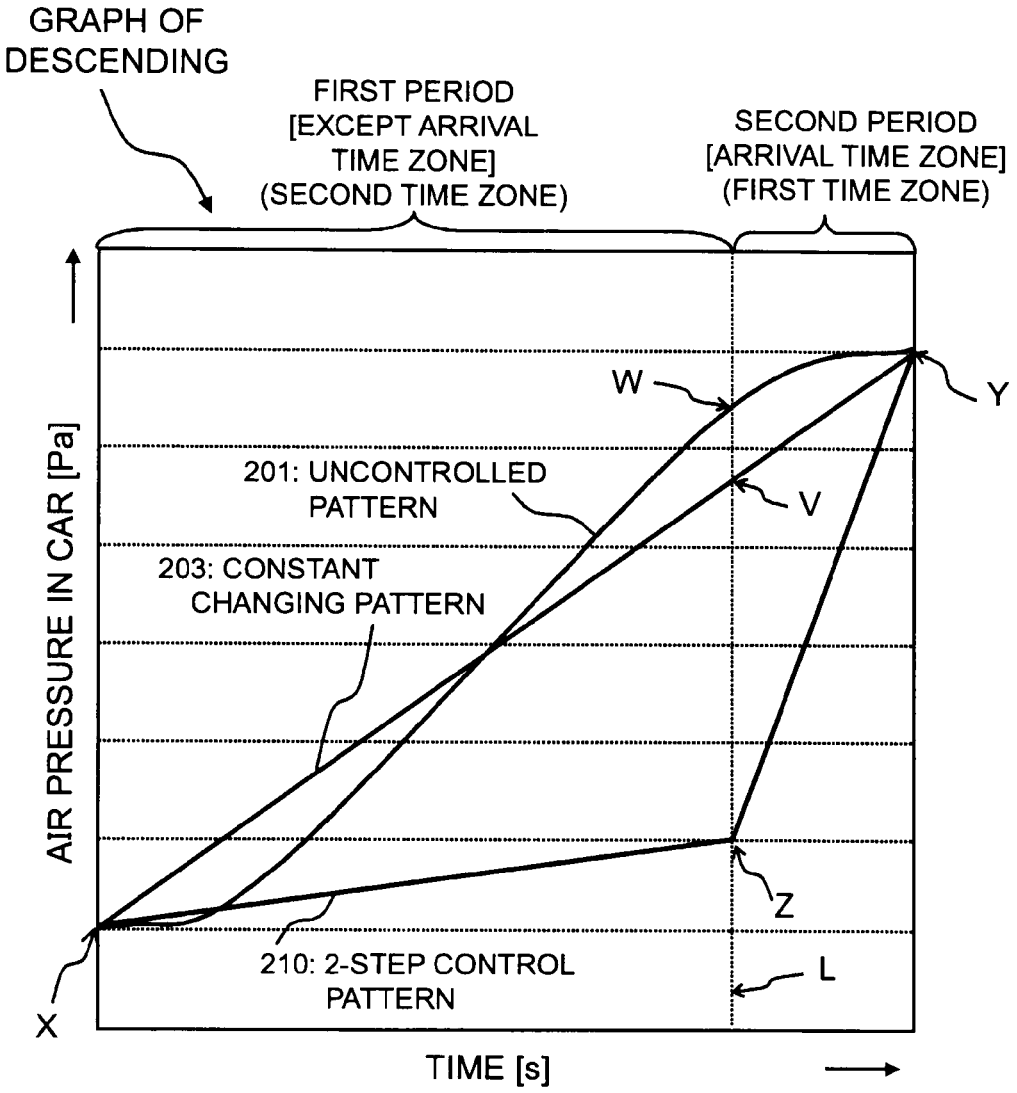
FIG. 9 a graph showing the 2-step control pattern 210 when the elevator car 102 is descending according to the second embodiment.
Figure 10:
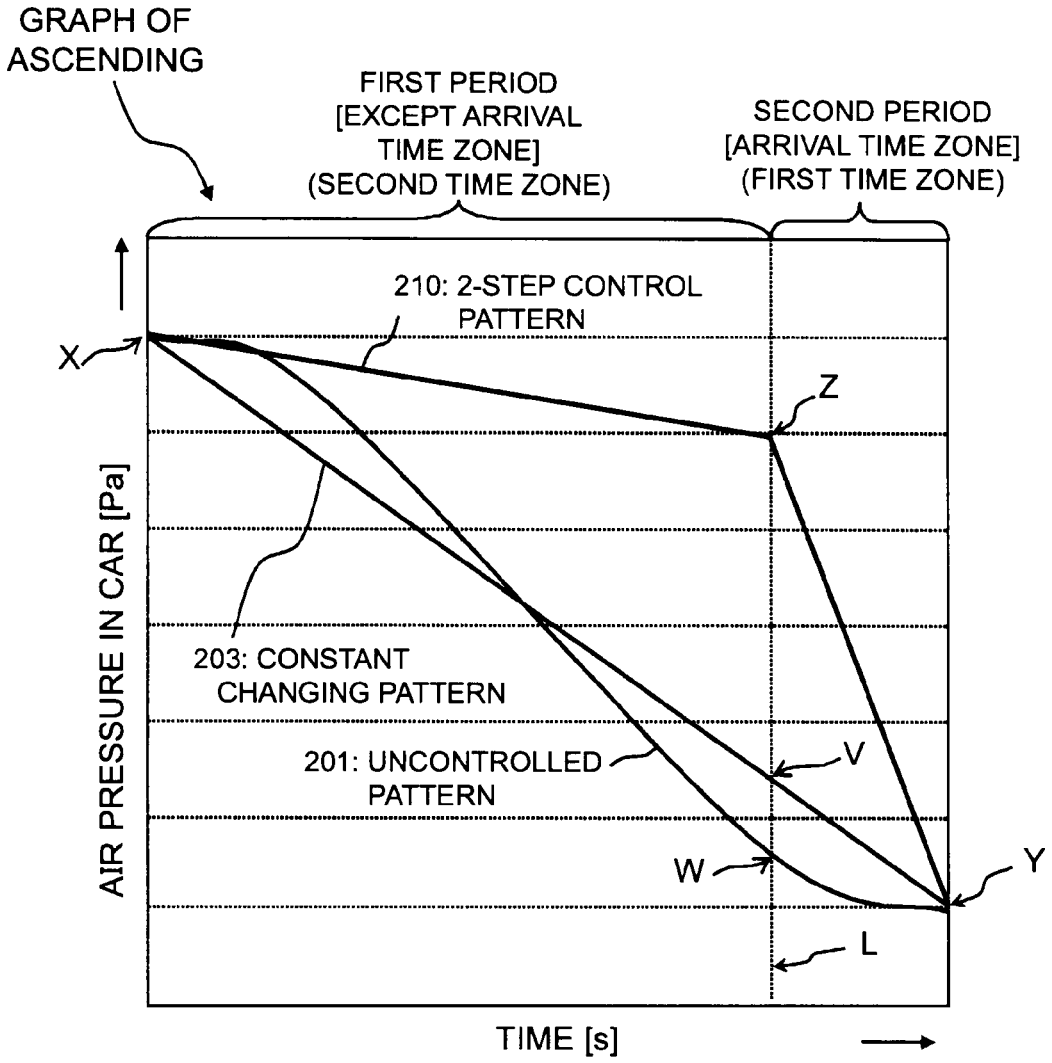
FIG. 10 is a graph showing the 2-step control pattern 210 when the elevator car 102 is ascending according to the second embodiment.
Figure 11:
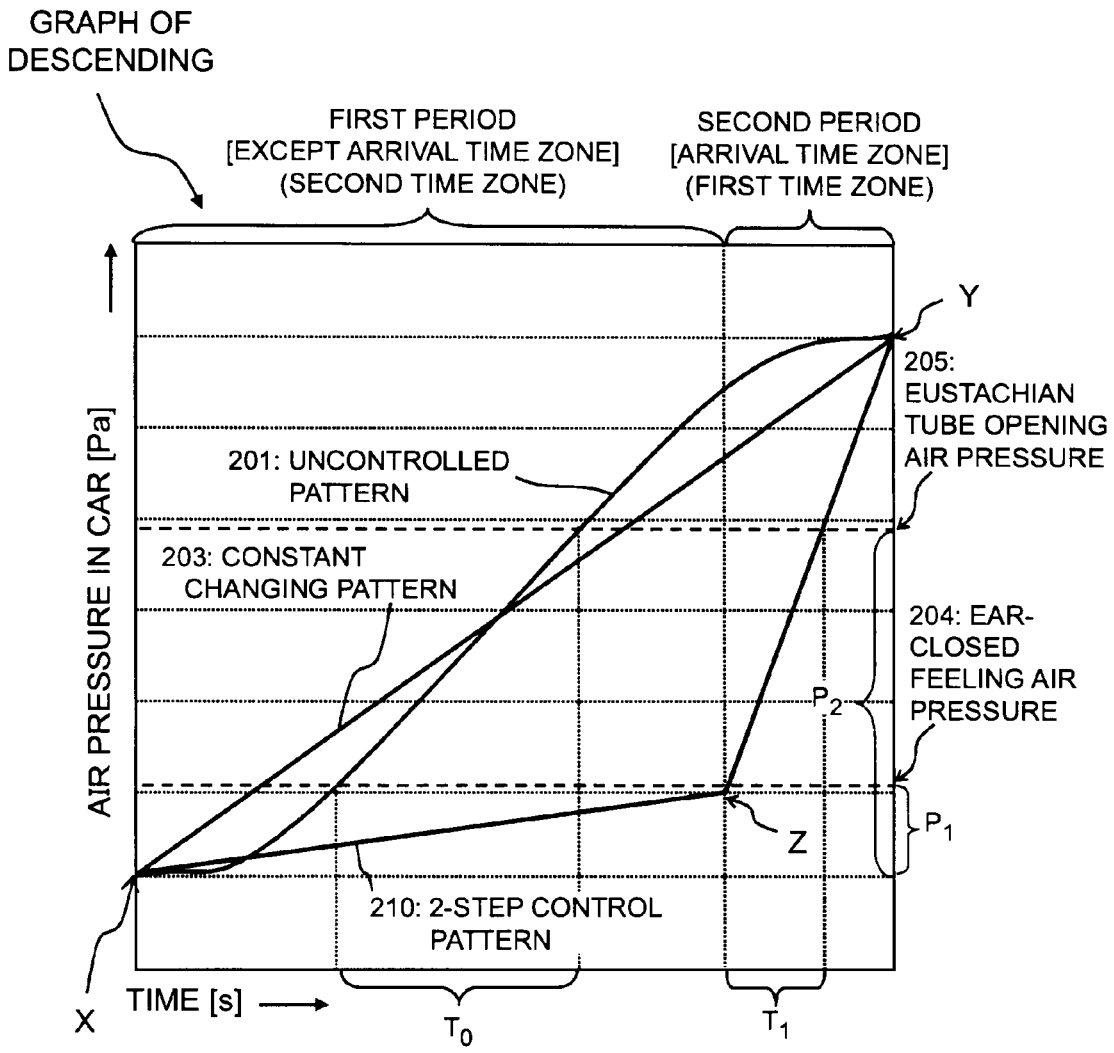
FIG. 11 is a graph showing a time when ear-closed feeling occurs by the 2-step control pattern 210 while the elevator car 102 is descending according to the second embodiment.
Figure 12:
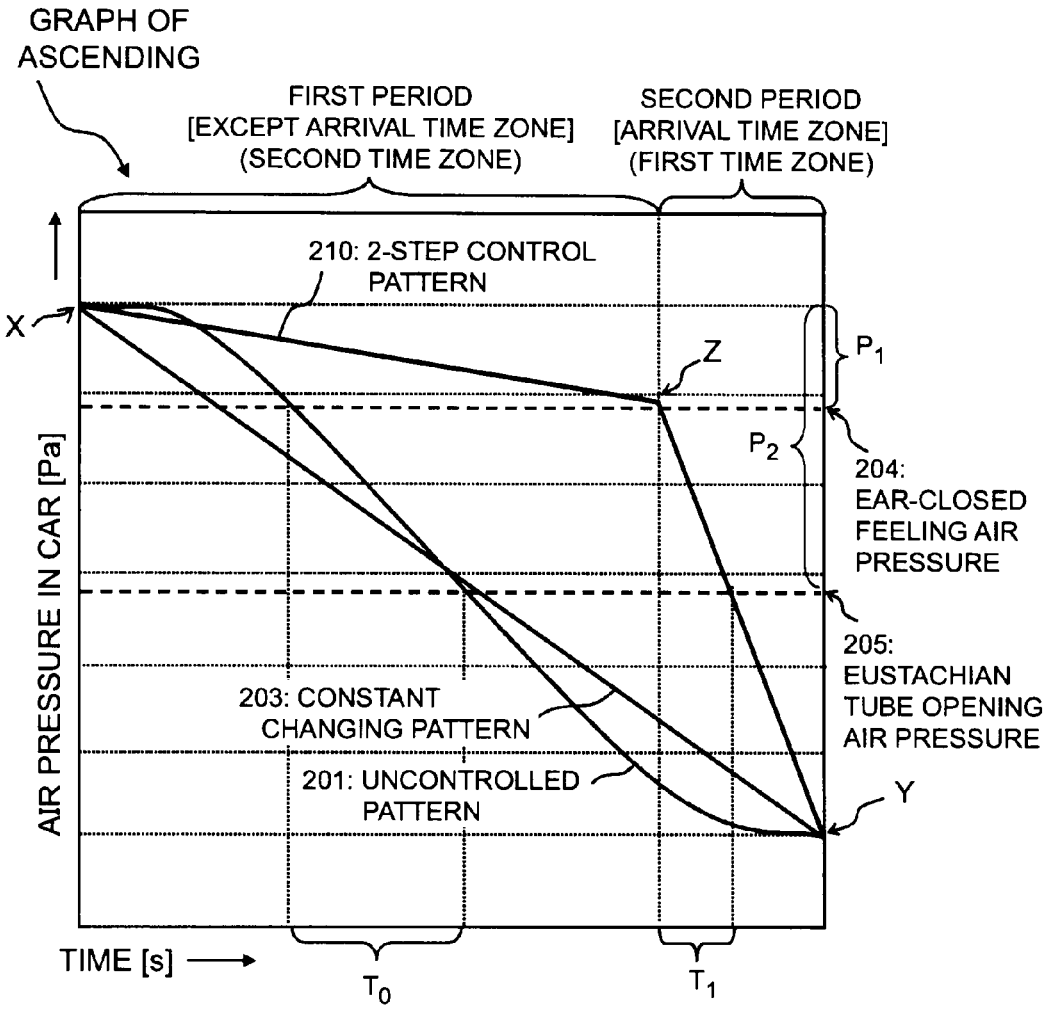
FIG. 12 is a graph showing a time when ear-closed feeling occurs by the 2-step control pattern 210 while the elevator car 102 is ascending according to the second embodiment.
Figure 13:
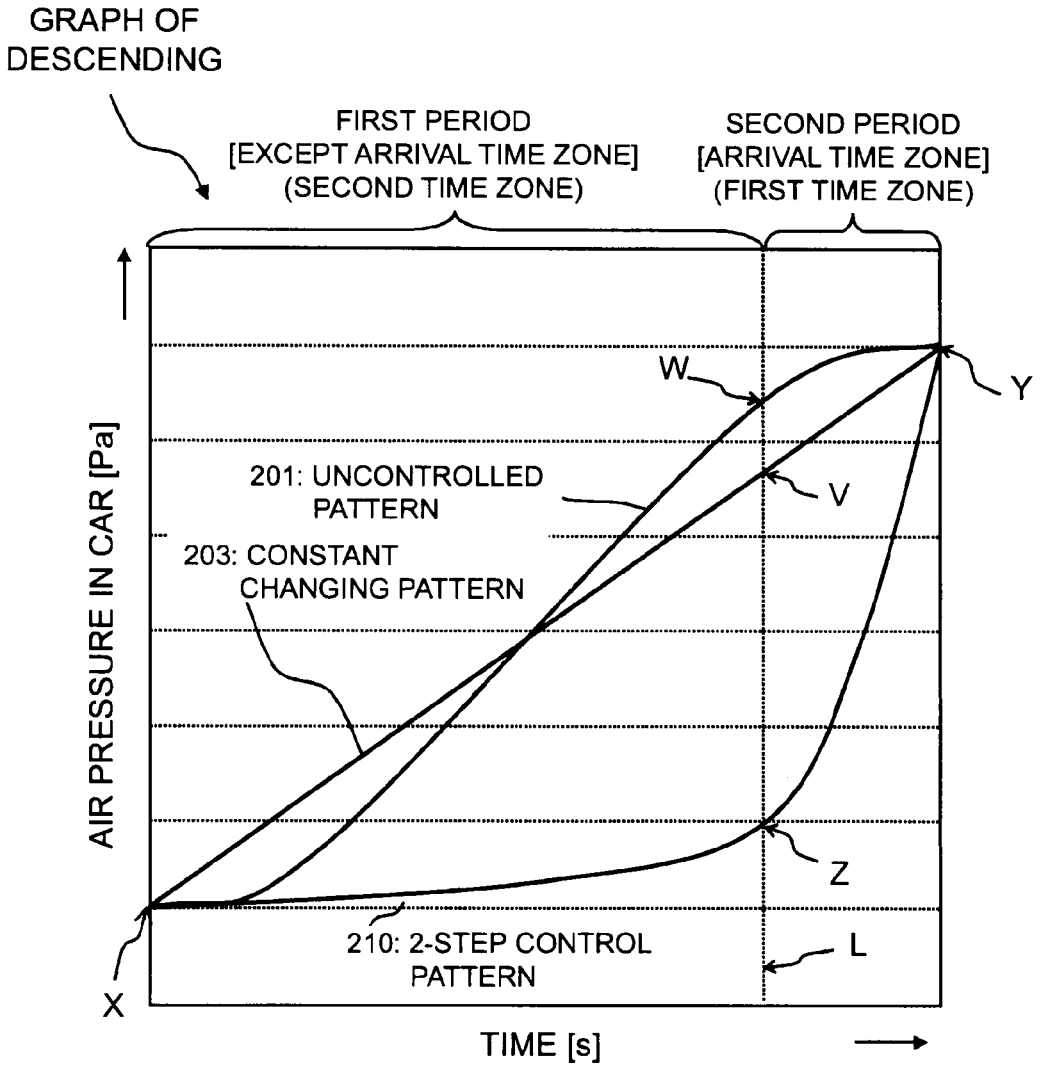
FIG. 13 is a graph showing the 2-step control pattern 210 when the elevator car 102 is descending according to the second embodiment.
Figure 14:
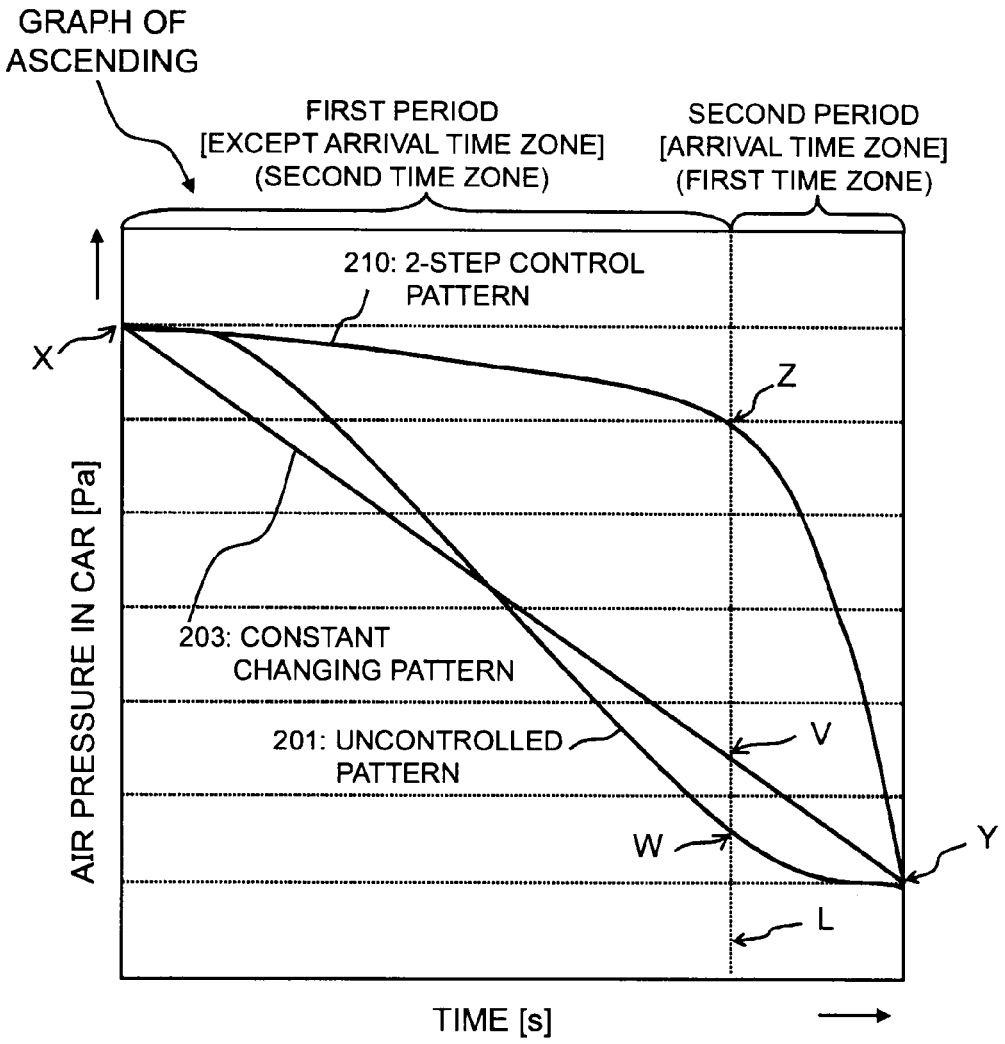
FIG. 14 is a graph showing the 2-step control pattern 210 when the elevator car 102 is ascending according to the second embodiment.
Figure 15:
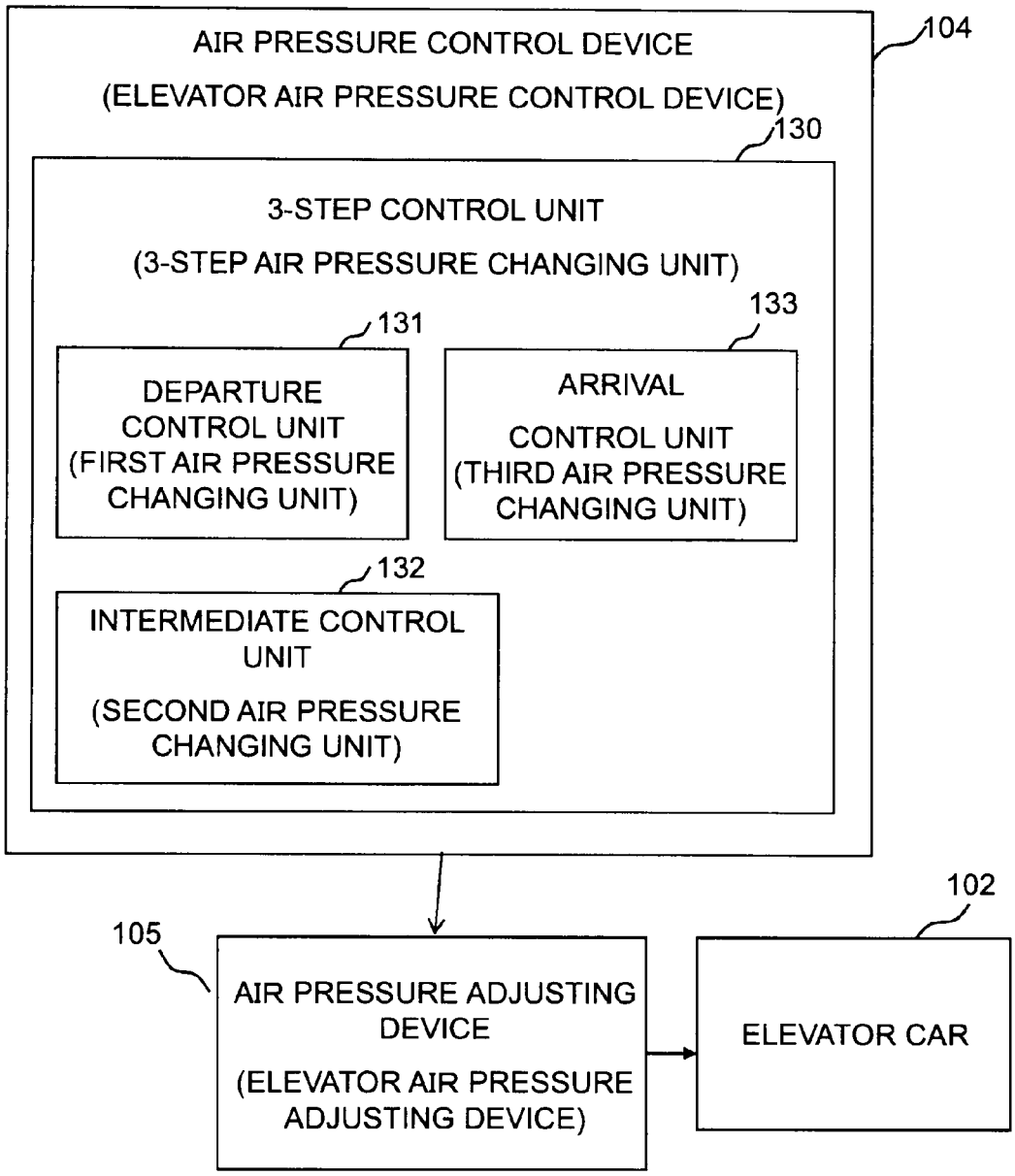
FIG. 15 is a functional configuration diagram of an air pressure control device 104 according to the third embodiment.
Figure 16:
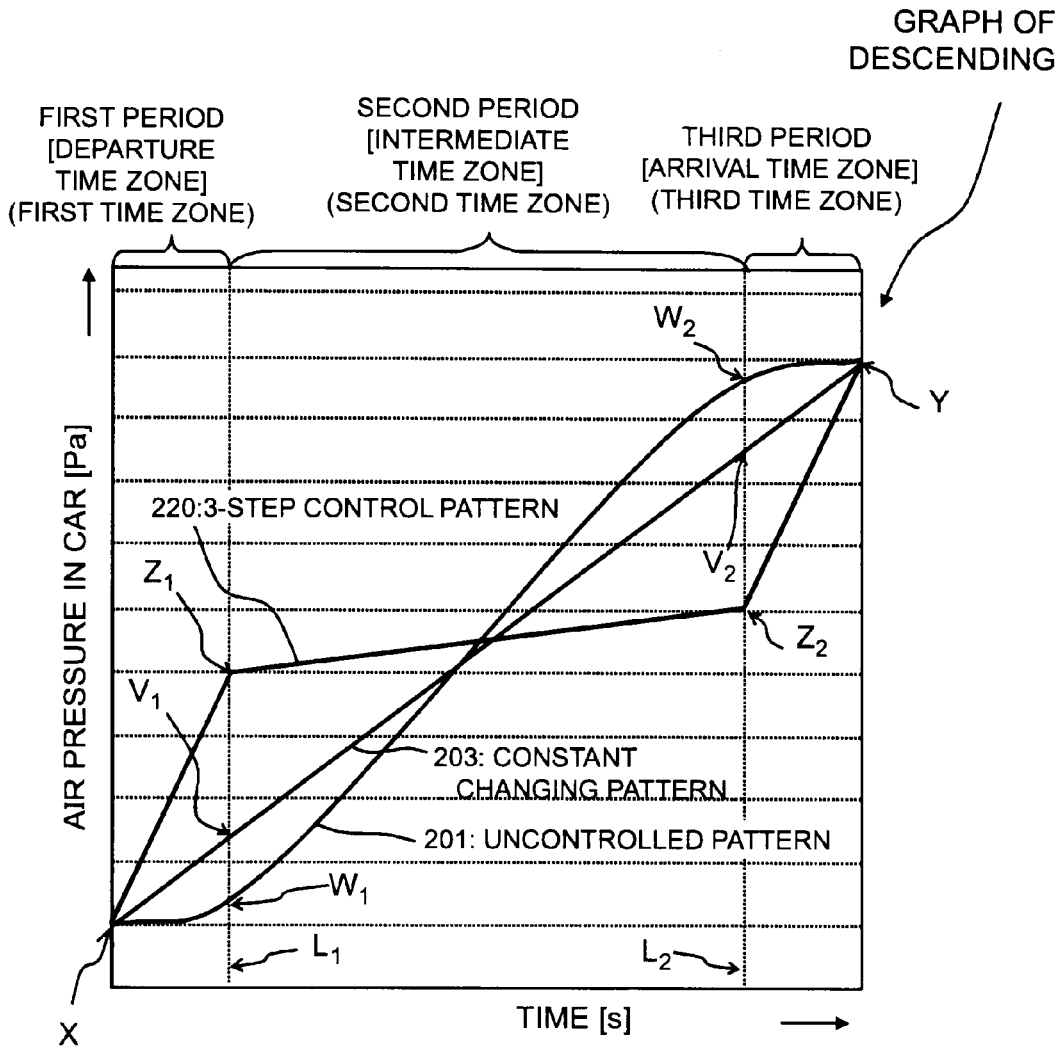
FIG. 16 is a graph showing a 3-step control pattern 220 when the elevator car 102 is descending according to the third embodiment.
Figure 17:
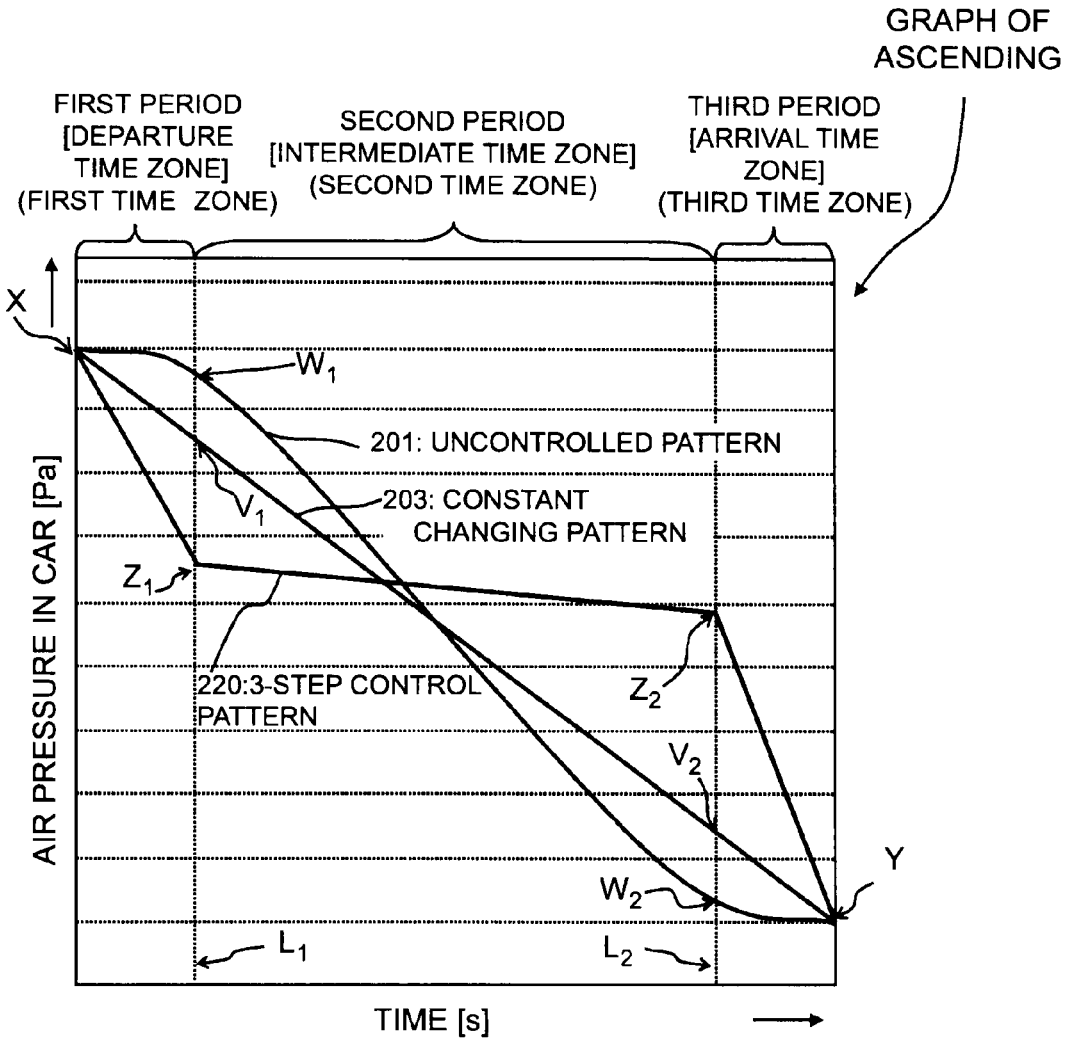
FIG. 17 is a graph showing the 3-step control pattern 220 when the elevator car 102 is ascending according to the third embodiment.
Figure 18:
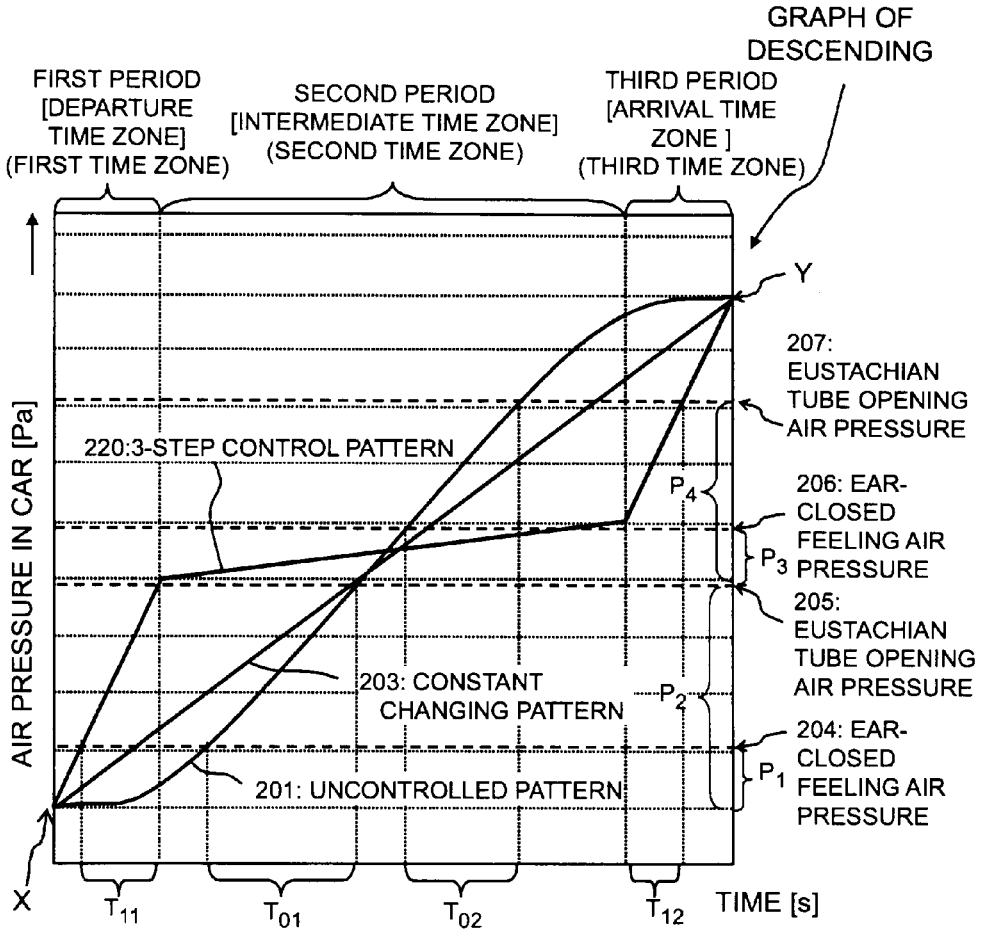
FIG. 18 is a graph showing a time when ear-closed feeling occurs by the 3-step control pattern 220 while the elevator car 102 is descending according to the third embodiments.
Figure 19:
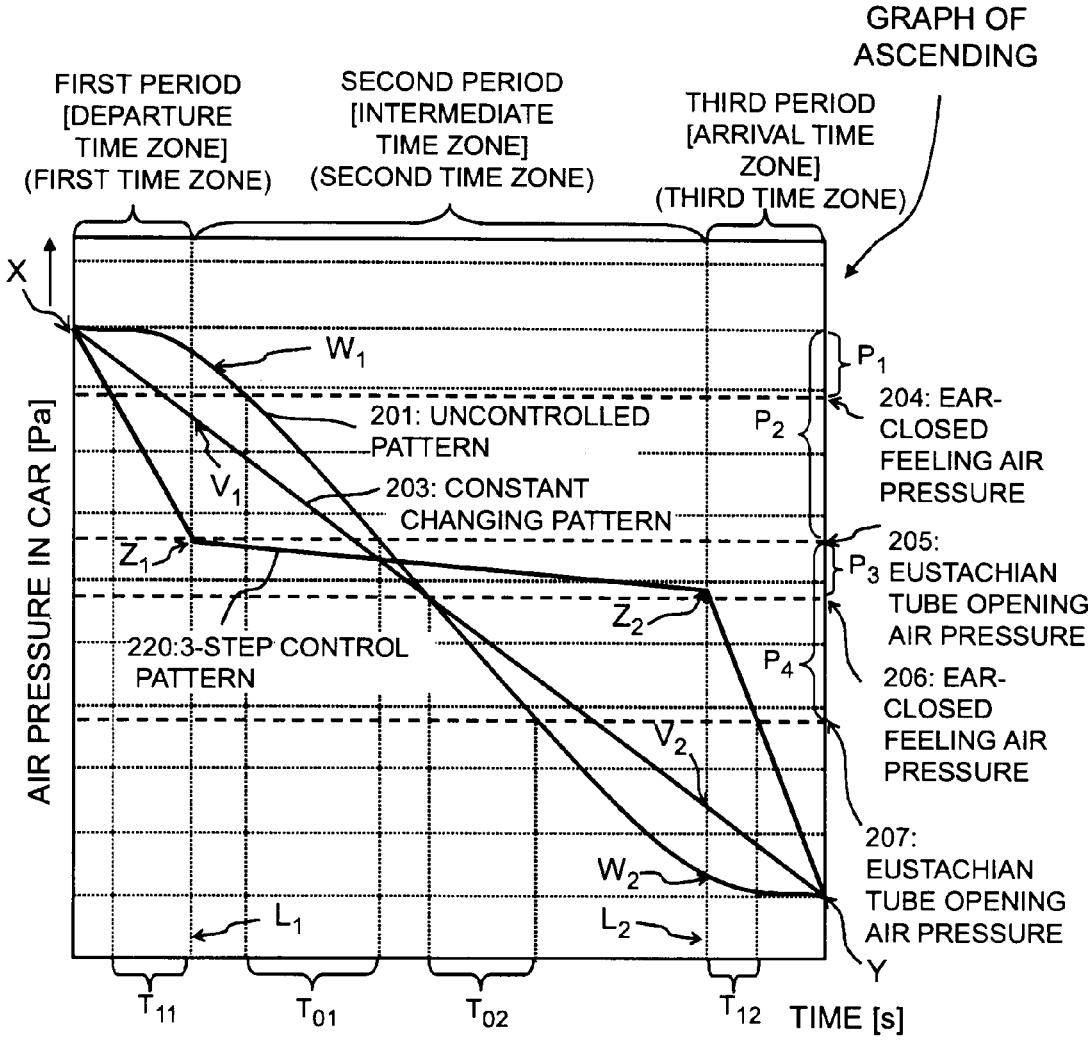
FIG. 19 is a graph showing a time when ear-closed feeling occurs by the 3-step control pattern 220 while the elevator car 102 is ascending according to the third embodiment.
Figure 20:
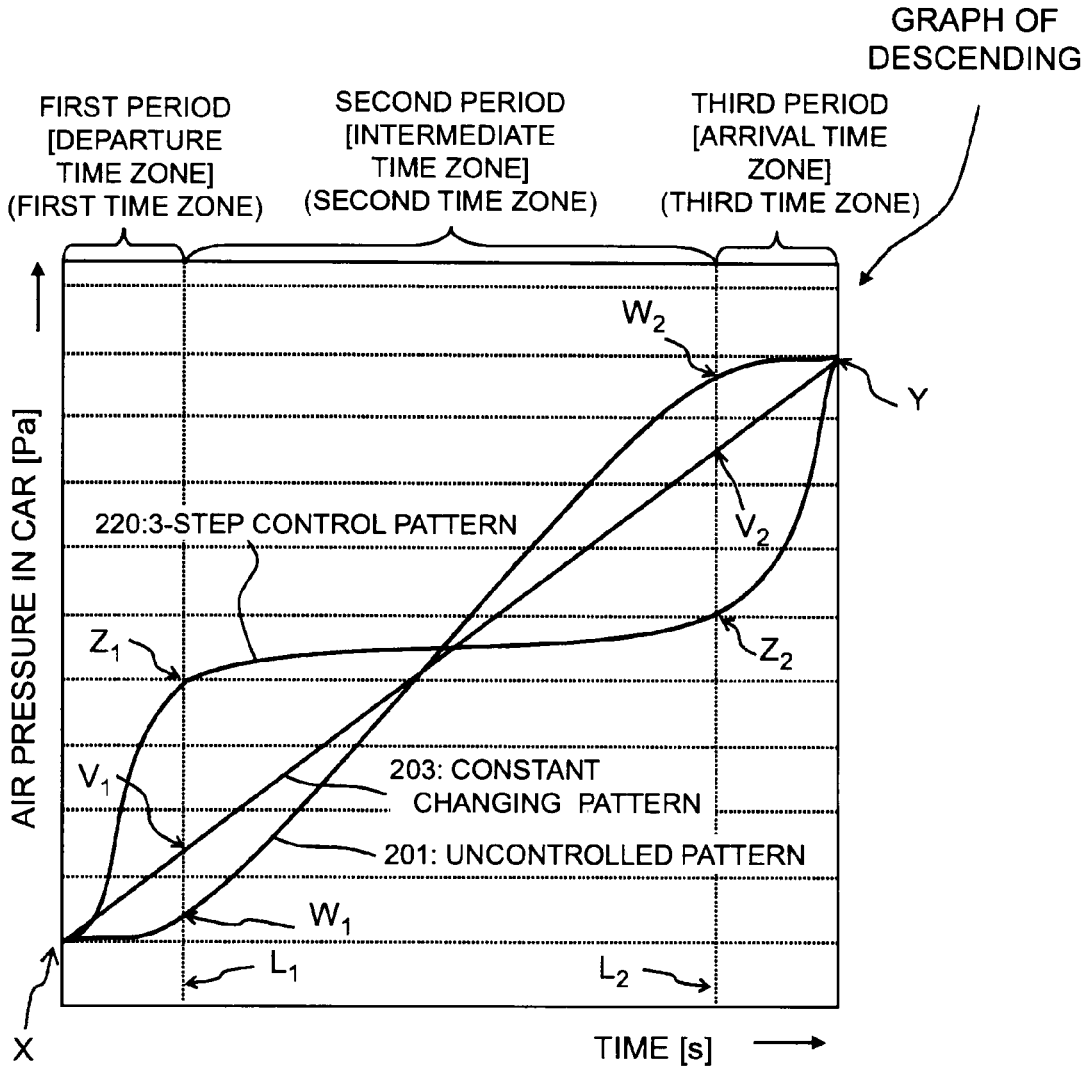
FIG. 20 is a graph showing the 3-step control pattern 220 when the elevator car 102 is descending according to the third embodiment.
Figure 21:
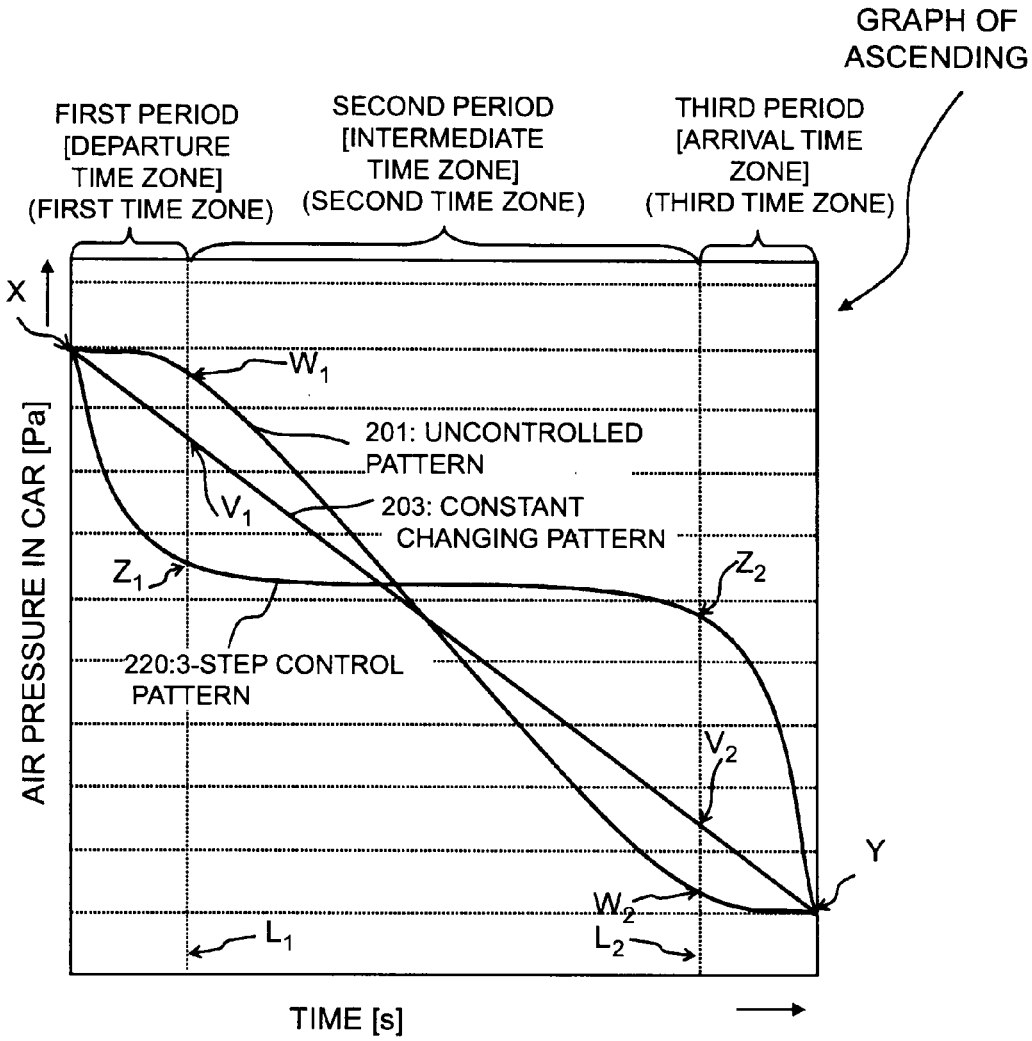
FIG. 21 is a graph showing the 3-step control pattern 220 when the elevator car 102 is ascending according to the third embodiment.
Figure 22:
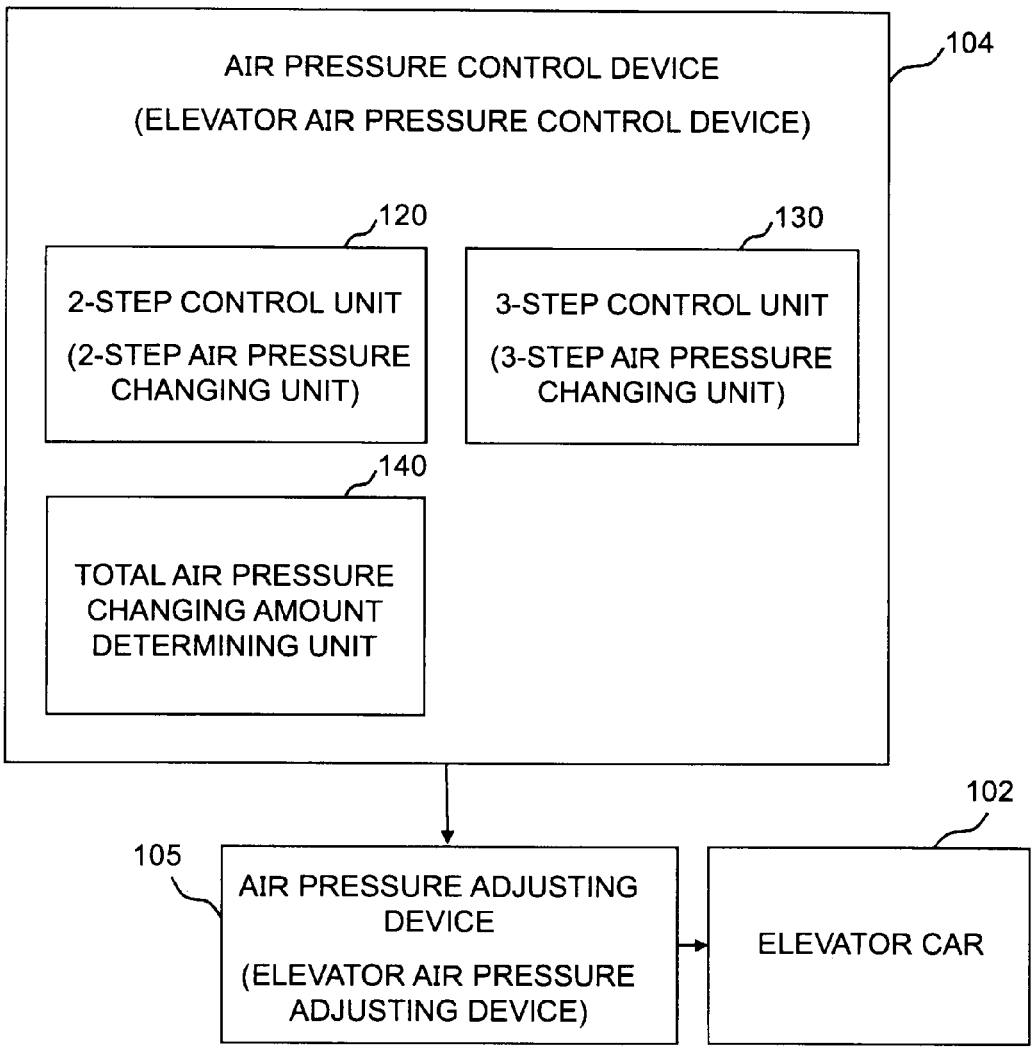
FIG. 22 is a functional configuration diagram of an air pressure control device 104 according to the fifth embodiment.
Figure 23:
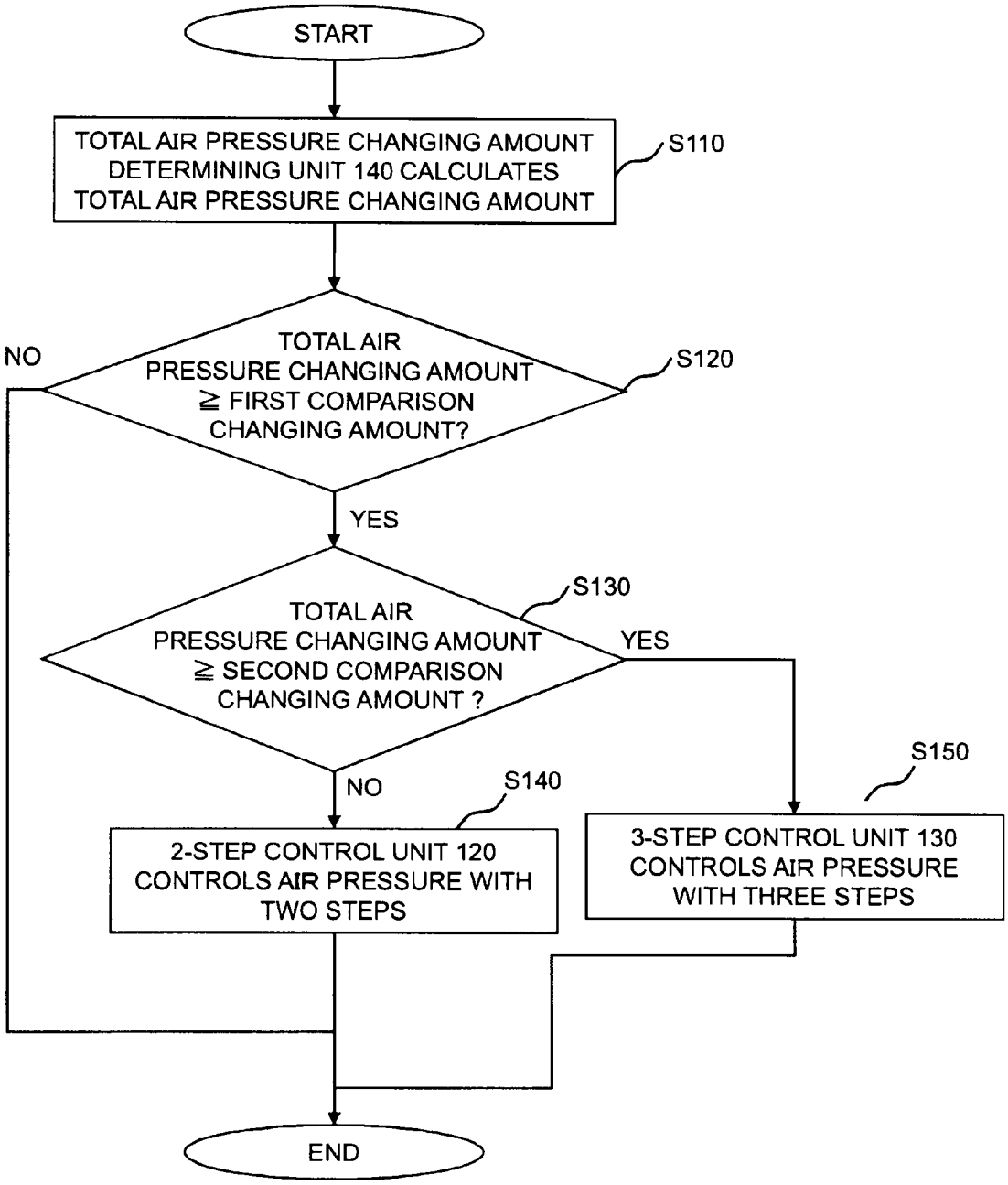
FIG. 23 is a flowchart showing an air pressure control method of the air pressure control device 104 according to the fifth embodiment.
Figure 24:
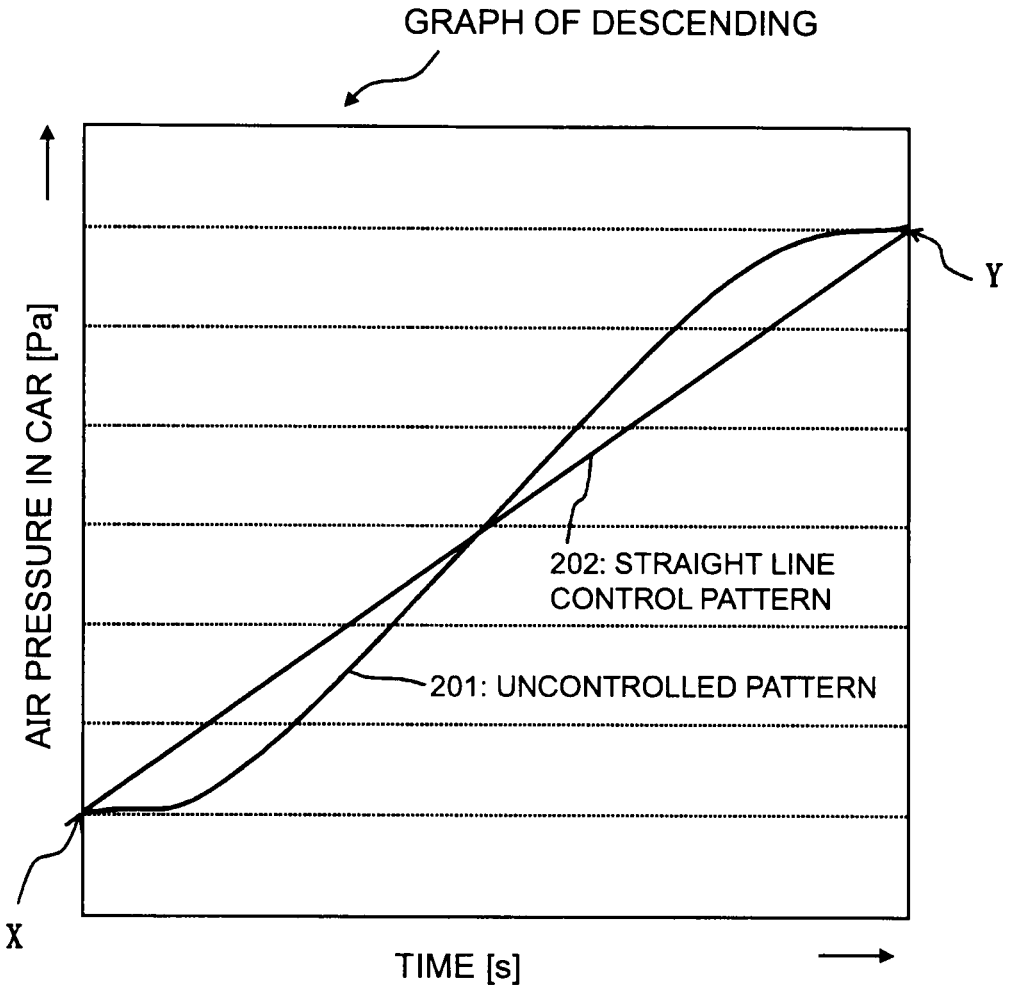
FIG. 24 shows an air pressure control pattern when a conventional elevator car descends.

100: an elevator, 101: a hoistway; 102: an elevator car; 103, 103*a*, 103*b*: an elevator boarding place; 104: an air pressure control device; 105: an air pressure adjusting device; 106: a counterweight; 107: a hoisting machine; 108: a suspension rope; 109: an elevator control device; 120: a 2-step control unit; 121: a departure/arrival control unit; 122: an except departure/arrival control unit; 130: 3-step control unit; 131: a departure control unit; 132: an intermediate control unit; 133: an arrival control unit; 140: a total air pressure changing amount determining unit; 201: an uncontrolled pattern; 202: a straight line control pattern; 203: a constant changing pattern; 204, 206: an ear-closed feeling air pressure; 205, 207: a Eustachian tube opening air pressure; 210: a 2-step control pattern; 211: a 2-step control pattern A; 212: a 2-step control pattern B; and 220: a 3-step control pattern.

The invention claimed is:

1. An elevator air pressure control device in an elevator car having an air pressure adjusting device, for carrying out at least one of air pressure control of controlling the air pressure adjusting device for decreasing air pressure when the elevator car ascends and controlling the air pressure adjusting device for increasing the air pressure when the elevator car descends, the elevator air pressure control device comprising:

a first air pressure changing unit configured to control the air pressure adjusting device to change the air pressure in the elevator car by a predetermined first air pressure changing amount during a predetermined first portion of a time period during which the elevator car is moving between two floors; and a second air pressure changing unit configured to control the air pressure adjusting device to change the air pressure in the elevator car by a predetermined second air pressure changing amount during a predetermined second portion of the time period during which the elevator car is moving between the two floors, wherein the second air pressure changing amount is different from the first air pressure changing amount, wherein the first portion of the time period is a departure time having a predetermined time length starting when the elevator car departs from a departure floor, wherein a second portion of the time period is a time while the elevator car is moving between the two floors, excluding the first portion of the time period, and wherein a time length of the first portion of the time period is a time length required by the elevator car to reach a maximum speed after the elevator car starts moving.

2. The elevator air pressure control device of claim 1, wherein a time length of the first portion of the time period is shorter than a time length of the second portion of the time period.

3. The elevator air pressure control device of claim 1, wherein the first air pressure changing amount is larger than the second air pressure changing amount.

4. The elevator air pressure control device of claim 1, wherein the first air pressure changing amount is larger than an air pressure changing amount corresponding to a height difference caused by movement of the elevator car in the first portion of the time period.

5. The elevator air pressure control device of claim 1, wherein the first air pressure changing amount is larger than an air pressure changing amount corresponding to a height difference caused by movement of the elevator car in a time length of the first portion of the time period at an average speed of movement from the departure floor to the arrival floor.

6. The elevator air pressure control device of claim 1, wherein the first air pressure changing amount is at least 2400 Pa during descent of the elevator car and at least 2000 Pa during ascent of the elevator car.

7. The elevator air pressure control device of claim 1, wherein the first air pressure changing amount when the elevator car descends is larger than the first air pressure changing amount when the elevator car ascends.

8. The elevator air pressure control device of claim 1, wherein a first air pressure changing rate which is an average changing rate of the air pressure in the elevator car in the first portion of the time period is larger than a second air pressure changing rate which is an average changing rate of the air pressure in the elevator car in the second portion of the time period.

9. The elevator air pressure control device of claim 1, wherein a first air pressure changing rate which is an average changing rate of the air pressure in the elevator car in the first portion of the time period is a maximum value of an air pressure changing rate specified based on at least one of adjusting performance of the elevator air pressure adjusting device and pressure resistant performance of the elevator car.

10. The elevator air pressure control device of claim 1, wherein the first air pressure changing unit is configured to specify the first air pressure changing amount based on the departure floor and the arrival floor.

11. An elevator air pressure control device in an elevator car having an air pressure adjusting device, for carrying out at least one of air pressure control of controlling the air pressure adjusting device for decreasing air pressure when the elevator car ascends and controlling the air pressure adjusting device for increasing the air pressure when the elevator car descends, the elevator air pressure control device comprising:

a first air pressure changing unit configured to control the air pressure adjusting device to change the air pressure in the elevator car by a predetermined first air pressure changing amount during a predetermined first portion of a time period during which the elevator car is moving between two floors; and a second air pressure changing unit configured to control the air pressure adjusting device to change the air pressure in the elevator car by a predetermined second air pressure changing amount during a predetermined second portion of the time period during which the elevator car is moving between the two floors, wherein the second air pressure changing amount is different from the first air pressure changing amount, further comprising:

a third air pressure changing unit configured to control the air pressure adjusting device to change the air pressure in the elevator car by a predetermined third air pressure changing amount during a predetermined third portion of the time period while the elevator car is moving between the two floors.

12. The elevator air pressure control device of claim 11, wherein the first portion of the time period is a departure time having a predetermined time length starting when the elevator car departs from the departure floor and corresponding to a time length required by the elevator car to reach a maximum speed after the elevator car starts moving, wherein the third portion of the time period is an arrival time having a predetermined time length terminating when the elevator car arrives at the arrival floor and corresponding to a time length required by the elevator car for stopping after the elevator car starts decelerating from the maximum speed, and wherein the second portion of the time period is an intermediate time after the departure time and before the arrival time while the elevator car is moving.

13. An elevator air pressure control device in an elevator car having an air pressure adjusting device, for carrying out at least one of air pressure control of controlling the air pressure adjusting device for decreasing air pressure when the elevator car ascends and controlling the air pressure adjusting device for increasing the air pressure when the elevator car descends, the elevator air pressure control device comprising:

a 2-step air pressure changing unit configured to control the air pressure adjusting device to change the air pressure in the elevator car by a predetermined departure or arrival air pressure changing amount during a predetermined departure or arrival portion of a time period during which the elevator car is moving between two floors, wherein the predetermined departure or arrival portion of a time period during which the elevator car is moving between two floors is one of a predetermined departure time period starting when the elevator car departs from a departure floor and a predetermined arrival time period terminating when the elevator car arrives at an arrival floor, and to change the air pressure in the elevator car by a predetermined except departure or arrival air pressure changing amount during the time period during which the elevator car is moving between two floors other than the predetermined departure or arrival portion, wherein the predetermined except departure or arrival air pressure changing amount is different from the predetermined departure or arrival air pressure changing amount; and a 3-step air pressure changing unit configured to control the air pressure adjusting device to change the air pressure in the elevator car by a predetermined departure air pressure changing amount during the predetermined departure time period, to change the air pressure in the elevator car by a predetermined arrival air pressure changing amount during the predetermined arrival time period, and to change the air pressure in the elevator car by a predetermined air pressure changing amount that is different from either of the predetermined departure air pressure changing amount and the predetermined arrival air pressure changing amount during the time period during which the elevator car is moving between two floors other than the predetermined departure time period and the predetermined arrival time period, wherein the elevator air pressure control device includes a portion configured to select one of the 2-step air pressure changing unit and the 3-step air pressure changing unit to control the air pressure adjusting device to change the air pressure in the elevator car, based on a determination of a departure floor and arrival floor of the elevator car.

14. An elevator air pressure control device in an elevator car having an air pressure adjusting device, for carrying out at least one of air pressure control of controlling the air pressure adjusting device for decreasing air pressure when the elevator car ascends and controlling the air pressure adjusting device for increasing the air pressure when the elevator car descends, the elevator air pressure control device comprising:

a first air pressure changing unit configured to control the air pressure adjusting device to change the air pressure in the elevator car by a predetermined first air pressure changing amount during a predetermined first portion of a time period during which the elevator car is moving between two floors; and a second air pressure changing unit configured to control the air pressure adjusting device to change the air pressure in the elevator car by a predetermined second air pressure changing amount during a predetermined second portion of the time period during which the elevator car is moving between the two floors, wherein the second air pressure changing amount is different from the first air pressure changing amount, wherein the first portion of the time period is an arrival time having a predetermined time length terminating when the elevator car arrives at an arrival floor, wherein a second portion of the time period is a time while the elevator car is moving between the two floors, excluding the first portion of the time period, and wherein a time length of the second portion of the time period is a time length required by the elevator car for stopping after the elevator car starts decelerating from the maximum speed.

15. The elevator air pressure control device of claim 14, wherein a time length of the first portion of the time period is shorter than a time length of the second portion of the time period.

16. The elevator air pressure control device of claim 14, wherein the first air pressure changing amount is larger than the second air pressure changing amount.

17. The elevator air pressure control device of claim 14, wherein the first air pressure changing amount is larger than an air pressure changing amount corresponding to a height difference caused by movement of the elevator car in the first portion of the time period.

18. The elevator air pressure control device of claim 14, wherein the first air pressure changing amount is larger than an air pressure changing amount corresponding to a height difference caused by movement of the elevator car in a time length of the first portion of the time period at an average speed of movement from the departure floor to the arrival floor.

19. The elevator air pressure control device of claim 14, wherein the first air pressure changing amount is at least 2400 Pa during descent of the elevator car and at least 2000 Pa during ascent of the elevator car.

20. The elevator air pressure control device of claim 14, wherein the first air pressure changing amount when the elevator car descends is larger than the first air pressure changing amount when the elevator car ascends.

21. The elevator air pressure control device of claim 14, wherein a first air pressure changing rate which is an average changing rate of the air pressure in the elevator car in the first portion of the time period is larger than a second air pressure changing rate which is an average changing rate of the air pressure in the elevator car in the second portion of the time period.

22. The elevator air pressure control device of claim 14, wherein a first air pressure changing rate which is an average changing rate of the air pressure in the elevator car in the first portion of the time period is a maximum value of an air pressure changing rate specified based on at least one of adjusting performance of the elevator air pressure adjusting device and pressure resistant performance of the elevator car.

23. The elevator air pressure control device of claim 14, wherein the first air pressure changing unit is configured to specify the first air pressure changing amount based on the departure floor and the arrival floor.

* * * * *